US007477209B2

(12) United States Patent
Wakabayashi et al.

(10) Patent No.: US 7,477,209 B2
(45) Date of Patent: Jan. 13, 2009

(54) PLASMA DISPLAY APPARATUS AND DRIVING METHOD THEREOF

(75) Inventors: Toshikazu Wakabayashi, Takatsuki (JP); Hiroyuki Tachibana, Suita (JP); Naoki Kosugi, Kyoto (JP); Ryuichi Murai, Toyonaka (JP); Kenji Ogawa, Takatsuki (JP); Yoshimasa Horie, Takatsuki (JP)

(73) Assignee: Panasonic Corporation, Osaka (JP)

( * ) Notice: Subject to any disclaimer, the term of this patent is extended or adjusted under 35 U.S.C. 154(b) by 593 days.

(21) Appl. No.: 10/561,922

(22) PCT Filed: Jun. 23, 2004

(86) PCT No.: PCT/JP2004/009221

§ 371 (c)(1),
(2), (4) Date: Dec. 22, 2005

(87) PCT Pub. No.: WO2004/114271

PCT Pub. Date: Dec. 29, 2004

(65) Prior Publication Data

US 2007/0109223 A1 May 17, 2007

(30) Foreign Application Priority Data

Jun. 24, 2003 (JP) ..... 2003-180028

(51) Int. Cl.
*G09G 3/28* (2006.01)

(52) U.S. Cl. ..... 345/60; 345/66; 345/67

(58) Field of Classification Search ..... 345/37–41, 345/60–69, 690–699; 315/169.1–169.4
See application file for complete search history.

(56) References Cited

U.S. PATENT DOCUMENTS

| | | | | |
|---|---|---|---|---|
| 6,313,580 | B1 | 11/2001 | Makino | |
| 6,496,167 | B2 | 12/2002 | Makino | |
| 6,512,501 | B1 | 1/2003 | Nagaoka et al. | |
| 6,608,609 | B1 | 8/2003 | Setoguchi et al. | |
| 6,876,340 | B2 * | 4/2005 | Kobayashi | 345/60 |
| 2003/0090443 | A1 | 5/2003 | Kobayashi | |

(Continued)

FOREIGN PATENT DOCUMENTS

EP 1 505 564 2/2005

(Continued)

OTHER PUBLICATIONS

Supplementary European Search Report issued Aug. 21, 2008 in European Application No. 04 74 6690.

*Primary Examiner*—Vijay Shankar
(74) *Attorney, Agent, or Firm*—Wenderoth, Lind & Ponack, L.L.P.

(57) ABSTRACT

During each set-up period, wall charges of scan electrodes and sustain electrodes, between which sustain discharges were generated in the previous subfield, are adjusted, and parts toward the sustain electrodes of positive charges in the scan electrodes are replaced by negative charges and parts toward the scan electrodes of negative charges in the sustain electrodes are replaced by positive charges. During each address period, write pulses are applied to the scan electrodes to generate write discharges utilizing priming discharges between the scan electrodes and priming electrodes. During each sustain period, positive charges are accumulated in the entire surfaces of the scan electrodes and negative charges are accumulated in the entire surfaces of the sustain electrodes.

11 Claims, 17 Drawing Sheets

U.S. PATENT DOCUMENTS

| | | | |
|---|---|---|---|
| 2004/0095294 | A1 | 5/2004 | Yamada |
| 2005/0200570 | A1 | 9/2005 | Tachibana et al. |
| 2005/0219156 | A1 | 10/2005 | Tachibana et al. |
| 2006/0050023 | A1 | 3/2006 | Tachibana et al. |

FOREIGN PATENT DOCUMENTS

| | | |
|---|---|---|
| EP | 1 513 132 | 3/2005 |
| EP | 1 607 930 | 12/2005 |
| JP | 11-133913 | 5/1999 |
| JP | 11-297211 | 10/1999 |
| JP | 2000-20021 | 1/2000 |
| JP | 2000-294149 | 10/2000 |
| JP | 2001-195990 | 7/2001 |
| JP | 2001-228821 | 8/2001 |
| JP | 2002-297091 | 10/2002 |
| JP | 2003-151445 | 5/2003 |

* cited by examiner

PLASMA DISPLAY APPARATUS AND DRIVING METHOD THEREOF

TECHNICAL FIELD

The present invention relates to a plasma display apparatus for displaying images in gradation by dividing one field into a plurality of subfields, and a driving method for such a plasma display apparatus.

BACKGROUND TECHNOLOGY

Plasma display apparatuses have advantages of being able to be thinned and to have larger screens. An AC plasma display panel used in such a plasma display apparatus is such that a front plate made of a glass substrate and formed by arraying a plurality of rows of scan electrodes and sustain electrodes for carrying out surface discharges, and a back plate on which data electrodes are arrayed in a plurality of rows are so combined that the scan electrodes and the sustain electrodes are orthogonal to the data electrodes, thereby forming matrix-shaped discharge cells, as disclosed, for example, in Japanese Unexamined Patent Publication No. 2001-195990.

A subfield method for displaying a halftone by temporally overlapping a plurality of weighted binary images is known as a method for driving the plasma display panel constructed as above. According to this subfield method, one field is temporally divided into a plurality of subfields, which are respectively weighted. The weights of the respective subfields correspond to emission amounts of the subfields. For example, the numbers of emissions are used as the weights, and a total amount of the weights of the respective subfields corresponds to the luminance, i.e. gradation level of a video signal.

Each subfield is comprised of a set-up period, an address period and a sustain period, wherein wall charges of the respective electrodes are adjusted during the set-up period, write discharges are generated between the data electrodes and the scan electrodes during the address period, and only the discharge cells where the write discharges were generated carry out sustain discharges between the scan electrodes and the sustain electrodes. The number of emissions by the sustain discharges becomes the weight of the subfield, and various video images are displayed in gradation at a luminance corresponding to the number of emissions.

However, in the above AC plasma display panel, strong write discharges are generated between the data electrodes and the scan electrodes forming the discharge cells in order to generate stable sustain discharges, and strong discharges occur between the scan electrodes and the sustain electrodes of the discharge cells during these write discharges. Error discharges occur between the scan electrodes and the sustain electrodes of the adjacent discharge cells by these strong discharges, whereby crosstalk occurs between adjacent lines to deteriorate the quality of the display image. Further, since the light emissions by the strong write discharges becomes unnecessary lights, a black luminance in the absence of signals cannot be sufficiently depressed, thereby deteriorating the quality of the display image.

DISCLOSURE OF THE INVENTION

An object of the present invention is to provide a plasma display apparatus capable of sufficiently reducing crosstalk and sufficiently depressing a black luminance in the absence of signals, and a method for driving such a plasma display apparatus.

One aspect of the present invention is directed to a plasma display apparatus for displaying images in gradation while dividing the one field into a plurality of subfields each including a set-up period, an address period and a sustain period, comprising an AC plasma display panel formed with a plurality of scan electrodes and a plurality of sustain electrodes, an electrode array comprised of two scan electrodes and two sustain electrodes arrayed in this order being one unit, a plurality of priming electrodes each opposed to an adjacent scan electrodes, and a plurality of data electrodes extending in such a direction as to cross the scan electrodes and the sustain electrodes; first driving means for adjusting wall charges of the scan electrodes and the sustain electrodes, between which sustain discharges were generated in the previous subfield, during each set-up period; second driving means for, during each address period, applying write pulses to the scan electrodes having the wall charges thereof adjusted by the first driving means to generate priming discharges between the scan electrodes and the priming electrodes, and applying write pulses to the data electrodes to generate write discharges utilizing the priming discharges; and third driving means for, during each sustain period, causing sustain discharges to be generated between the scan electrodes caused to generate the write discharges by the second driving means and the sustain electrodes to accumulate positive charges in the scan electrodes and negative charges in the sustain electrodes after the sustain discharges;

wherein the first driving means replaces parts toward the sustain electrodes of the positive charges in the scan electrodes accumulated by the third driving means by negative charges and replaces parts toward the scan electrodes of the negative charges in the sustain electrodes accumulated by the third driving means by positive charges.

In this plasma display apparatus, the wall charges of the scan electrodes decreased by the sustain discharges can be replenished and the write discharges can be stably generated during each address period since the wall charges of the scan electrodes and the sustain electrodes having generated the sustain discharges in the previous subfield are adjusted during each set-up period. Further, since the write discharges are generated between the scan electrodes and the data electrodes utilizing the priming discharges between the scan electrodes and the priming electrodes during each address period, the write discharges can be weakly and stably generated. Since unnecessary lights can be reduced by the weak write discharges, a black luminance in the absence of signals can be sufficiently depressed.

Further, positive charges are accumulated in the scan electrodes and negative charges are accumulated in the sustain electrodes after the sustain discharges of the scan electrodes having generated the write discharges during each sustain period, and the parts toward the sustain electrodes of the positive charges accumulated in the scan electrodes are replaced by negative charges and the parts toward the scan electrodes of the negative charges accumulated in the sustain electrodes are replaced by positive charges during each set-up period. Here, since the scan electrodes and the sustain electrodes are formed such that an electrode array of two scan electrodes and two sustain electrodes in this order is a unit, the sustain electrode forming one discharge cell is adjacent to the sustain electrode forming a discharge cell adjacent to the former discharge cell and negative charges remain between these two sustain electrodes. Accordingly, these negative charges function as a potential barrier wall between the adjacent discharge cells, thereby preventing the write discharge during the address period of one discharge cell from spreading to the other discharge cell. Therefore, crosstalk between adjacent lines can be sufficiently reduced.

In addition, since the charges have the polarities thereof reversed at a low potential during each set-up period, a driving circuit forming the first driving means can be produced at a lower cost.

The third driving means preferably makes the pulse duration of the last sustain pulses applied to the scan electrodes shorter than those of other sustain pulses.

In this case, specified charges can be uniformly accumulated in the entire surfaces of the scan electrodes and the sustain electrodes since strong sustain discharges can be generated between the scan electrodes and the sustain electrodes.

The first driving means preferably applies set-up pulses for vertical synchronization applied once during a vertical synchronization period at a first voltage to the sustain electrodes at least when the display apparatus is turned on, and applies the set-up pulses for vertical synchronization thereto at a second voltage lower than the first voltage in other cases.

In this case, the set-up pulses for vertical synchronization can be applied to the sustain electrodes at the lower voltage except when the display apparatus is turned. Therefore, discharges caused by these pulses can be weakened to further depress the black luminance in the absence of signals.

The third driving means preferably causes the discharges to be generated between the scan electrodes and the priming electrodes by the last sustain pulses applied to the scan electrodes during each sustain period, thereby adjusting the wall charges of the priming electrodes.

In this case, the discharges are generated between the scan electrodes and the priming electrodes by the last sustain pulses applied to the scan electrodes to adjust the wall charges of the priming electrodes. Thus, a time between these discharges and the set-up discharges during the set-up period of the next subfield can be shortened, enabling the priming effect to be utilized in the next set-up discharges. As a result, even if being weak discharges, the set-up discharges can be stably generated. Therefore, unnecessary lights during the set-up periods can be reduced to further depress the black luminance and to stably generate the write discharges.

Preferably, the first driving means keeps the voltages of the priming electrodes at a first voltage during each set-up period; the second driving means increases the voltages of the priming electrodes to a second voltage higher than the first voltage and keeps them at the second voltage before the write discharges are generated during each address period; and the third driving means reduces the voltages of the priming electrodes from the second voltage to the first voltage during each sustain period.

In this case, the construction of a driving circuit for the priming electrodes can be simplified and power consumption and electromagnetic wave interference can be reduced since voltages to be applied to the priming electrodes take two values.

The first driving means preferably causes the discharges to be generated between the scan electrodes and the priming electrodes before the discharges between the scan electrodes and the sustain electrodes to adjust the wall charges of the priming electrodes during each set-up period.

In this case, the priming effect by the discharges between the scan electrodes and the priming electrodes can be utilized in the set-up discharges between the scan electrodes and the sustain electrodes since the discharges are generated between the scan electrodes and the priming electrodes to adjust the wall charges of the priming electrodes prior to the discharges between the scan electrodes and the sustain electrodes during each set-up period. As a result, even if being weak discharges, the set-up discharges can be stably generated. Therefore, unnecessary lights during the set-up periods can be reduced to further depress the black luminance and to stably generate the write discharges.

The first driving means may reduce the voltages of the priming electrodes from a first voltage to a second voltage lower than the first voltage and keeps them at the second voltage before the discharges between the scan electrodes and the sustain electrodes during each set-up period; and the second driving means may increase the voltages of the priming electrodes from the second voltage to the first voltage and keeps them at the first voltage before the generation of the write discharges during each address period.

In this case, the construction of the driving circuit for the priming electrodes can be simplified and power consumption and electromagnetic wave interference can be reduced since voltages to be applied to the priming electrodes take two values.

The plasma display panel preferably includes light absorbing layers formed at positions opposed to the priming electrodes.

In this case, strong discharges can be generated between the scan electrodes and the priming electrodes and the priming effect by these discharges can be sufficiently utilized since lights radiated by the discharges generated between the scan electrodes and the priming electrodes can be absorbed by the light absorbing layers.

The first driving means preferably sets the set-up period given once during the vertical synchronization period to be longer than the other set-up periods. In this case, the wall charges of the respective electrodes can be sufficiently adjusted during the set-up period given once during the vertical synchronization period, thereby enabling the succeeding priming discharges to be more stably generated.

The second driving means preferably increases the voltages of the priming electrodes to a predetermined voltage after increasing the voltages of the scan electrodes whose wall charges were adjusted by the first driving means to another predetermined voltage during each address period. In this case, the succeeding priming discharges can be more stably generated.

Another aspect of the present invention is directed to a method for driving a plasma display apparatus for displaying images in gradation while dividing one field into a plurality of subfields each including a set-up period, an address period and a sustain period, the apparatus comprising an AC plasma display panel formed with a plurality of scan electrodes and a plurality of sustain electrodes, an electrode array comprised of two scan electrodes and two sustain electrodes arrayed in this order being one unit, and a plurality of priming electrodes each opposed to an adjacent scan electrode, comprising an adjusting step of adjusting wall charges of the scan electrodes and the sustain electrodes, between which sustain discharges were generated in the previous subfields, during each set-up period; a writing step of, during each address period, applying write pulses to the scan electrodes having the wall charges thereof adjusted in the adjusting step to generate priming discharges between the scan electrodes and the priming electrodes, and applying write pulses to the data electrodes to generate write discharges utilizing the priming discharges; and a sustaining step of, during each sustain period, causing sustain discharges to be generated between the scan electrodes caused to generate the write discharges in the writing step and the sustain electrodes to accumulate positive charges in the scan electrodes and negative charges in the sustain electrodes after the sustain discharges; wherein the adjusting step includes a step of replacing parts toward the sustain electrodes of the positive charges in the scan electrodes accumulated in the sustaining step by negative charges and replacing parts toward the scan electrodes of the negative charges in the sustain electrodes accumulated in the sustaining step by positive charges.

According to this driving method, the wall charges of the scan electrodes and the sustain electrodes are adjusted during each set-up period and the write discharges are generated during each address period, utilizing the priming discharges between the scan electrodes and the priming electrodes. Thus, unnecessary lights can be reduced and the black luminance in the absence of signals can be sufficiently depressed by weakening the write discharges. Further, since the parts toward the sustain electrodes of positive charges in the scan electrodes are replaced by negative charges and the parts toward the scan electrodes of negative charges in the sustain electrodes are replaced by positive charges during each set-up period, the negative charges remaining between the adjacent sustain electrodes can be caused to function as potential barrier walls to prevent the write discharges during the address period from spreading to the adjacent discharge cells, thereby enabling crosstalk between adjacent lines to be sufficiently reduced. In addition, since the charges have the polarities thereof reversed at a low potential during each set-up period, the driving circuit can be produced at a lower cost.

BEST MODES FOR EMBODYING THE INVENTION

Figure 1:
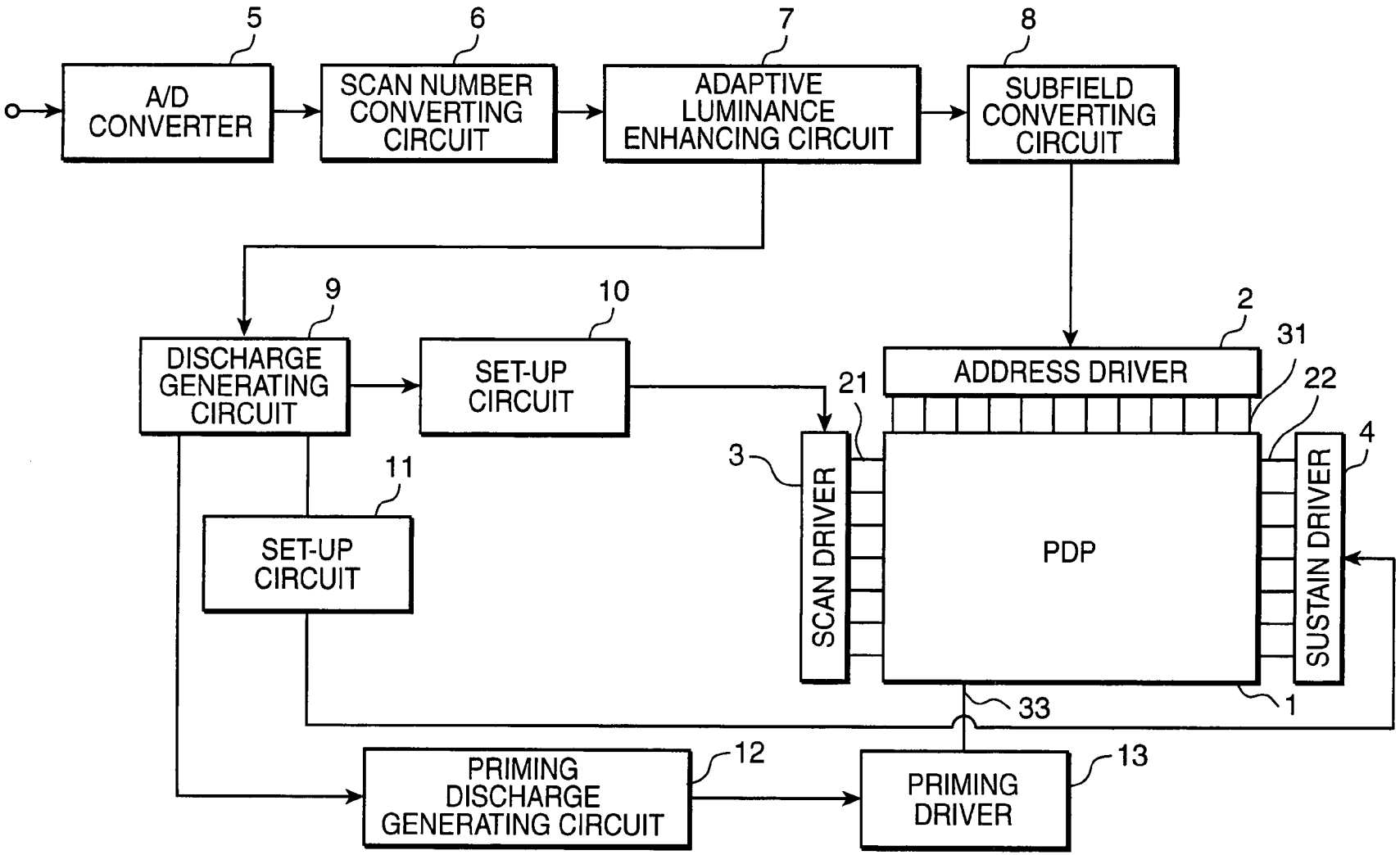
FIG. 1 is a block diagram showing a construction of a plasma display apparatus according to a first embodiment of the invention.

Hereinafter, a plasma display apparatus according to the present invention is described. FIG. 1 is a block diagram showing a construction of a plasma display apparatus according to a first embodiment of the invention.

The plasma display apparatus of FIG. 1 is provided with a plasma display panel (hereinafter, "PDP") 1, an address driver 2, a scan driver 3, a sustain driver 4, an A/D converter (analog-to-digital converter) 5, a scanning number converting circuit 6, an adaptive luminance enhancing circuit 7, a subfield converting circuit 8, a discharge generating circuit 9, set-up circuits 10, 11, a priming discharge generating circuit 12 and a priming driver 13.

A video signal VD is inputted to the A/D converter 5. Although not shown, horizontal synchronizing signals H and vertical synchronizing signals V are given to the A/D converter 5, the scanning number converting circuit 6, the adaptive luminance enhancing circuit 7, the subfield converting circuit 8, the discharge generating circuit 9 and the like. The A/D converter 5 converts the video signal VD into a digital image data and feeds it to the scanning number converting circuit 6. The scanning number converting circuit 6 converts the image data into image data of as many lines as the number of pixels of the PDP 1, and feeds the image data of each line to the adaptive luminance enhancing circuit 7.

The adaptive luminance enhancing circuit 7 determines a subfield number, a sustain pulse number, and the like corresponding to an average luminance level of the video signal, feeds the image data of as many lines as the number of pixels of the PDP 1 to the subfield converting circuit 8 together with the determined subfield number and the like while feeding the determined sustain pulse number and the like to the discharge generating circuit 9. A circuit disclosed in Japanese Patent Publication No. 2994630 may be used as the adaptive luminance enhancing circuit 7. However, it is not particularly limited to this example, and another adaptive luminance enhancing circuit may be used.

The image data of each line is comprised of a plurality of image data corresponding to a plurality of pixels of each line. The subfield converting circuit 8 divides each pixel data of the image data of each line into a plurality of bits corresponding to a plurality of subfields, and serially outputs the respective bits of each pixel data to the address driver 2 for each subfield.

In the plasma display apparatus shown in FIG. 1 is used an Address Display Separation method (hereinafter, "ADS method") for causing discharge cells to discharge while separating an address period for carrying out write discharges and a sustain period for carrying out sustain discharges. According to the ADS method, one field (1/60 sec.=16.67 ms) is temporarily divided into a plurality of subfields. Each subfield is divided into a set-up period, an address period and a sustain period, wherein each subfield is set up during the set-up period, the write discharges are carried out during the address period to select the discharge cells to be turned on and the sustain discharges for the display are carried out during the sustain period.

The discharge generating circuit 9 generates various discharge control timing signals based on the horizontal synchronizing signal H, the vertical synchronizing signal V, the sustain pulse number, etc.; feeds the control timing signals for the write discharges and the sustain discharges for the scan driver to the set-up circuit 10; feeds the control timing signals for the write discharges and the sustain discharges for the sustain driver to the set-up circuit 11; and feeds various timing signals such as the horizontal synchronizing signal H, the vertical synchronizing signal V and the sustain pulse number to the priming discharge generating circuit 12.

The set-up circuit 10 superimposes a set-up pulse onto the control timing signals for the write discharges and the sustain discharges for the scan driver, and feeds the discharge control signals for the scan driver to the scan driver 3. The set-up circuit 10 superimposes a set-up pulse onto the control timing signals for the write discharges and the sustain discharges for the sustain driver, and feeds the discharge control signals for the sustain driver to the sustain driver 4. The priming discharge generating circuit 12 feeds the discharge control timing signals for the priming driver to the priming driver 13.

The PDP 1 is an AC plasma display panel and includes a plurality of data electrodes 31, a plurality of scan electrodes 21, a plurality of sustain electrodes 22 and a plurality of priming electrodes 33. A plurality of data electrodes 31 are arrayed to extend in the vertical direction of the screen; a plurality of scan electrodes 21 and a plurality of sustain electrodes 22 are arrayed to extend in the horizontal direction of the screen. Discharge cells are formed at the respective intersections of the data electrodes 31, the scan electrodes 21 and the sustain electrodes 22, and construct the pixels on the screen.

The scan driver 3 is connected with a plurality of scan electrodes 21 of the PDP 1, and applies the set-up pulses to the scan electrodes 21 during the set-up period in accordance with the discharge control signals for the scan driver. The sustain driver 4 is connected with a plurality of sustain electrodes 22 of the PDP 1, and applies the set-up pulse to the sustain electrodes 22 during the set-up period in accordance with the discharge control timing signal for the sustain driver. In this way, set-up discharges are carried out at the pertinent discharge cells.

The priming driver 13 is connected with a plurality of priming electrodes 33 of the PDP 1, and applies set-up pulses to the priming electrodes 33 during the set-up period in accordance with the discharge control signals for priming driver. Thus, the set-up discharges are carried out between the pertinent priming electrodes and scan electrodes.

The address driver 2 is connected with a plurality of data electrodes 31 of the PDP 1 and converts data serially given for each subfield from the subfield converting circuit 8 into parallel data, and applies write pulses to the pertinent data electrodes 31 during the address period in accordance with the parallel data. The scan driver 3 successively applies write pulses to a plurality of scan electrodes 21 of the PDP 1 while shifting shift pulses in vertical scanning direction during the address period in accordance with the discharge control signals for scan driver. The priming driver 13 keeps the voltages of a plurality of priming electrodes 33 of the PDP 1 at a specified high voltage during the address period in accordance with the discharge control signals for priming driver. Thus, priming discharges are carried out between the scan electrodes 21 and the priming electrodes 33, and write discharges are carried out between the scan electrodes 21 and the data electrodes 31 utilizing these priming discharges.

The scan driver 3 applies periodical sustaining pulses to a plurality of scan electrodes 21 of the PDP 1 during the sustain period in accordance with the discharge control signals for sustain driver. The sustain driver 4 simultaneously applies sustain pulses whose phases are shifted by 180° with respect to the sustain pulses of the scan electrodes 21 in accordance with the discharge control signals for sustain driver. Thus, sustain discharges are carried out in the pertinent discharge cells.

Figure 2:
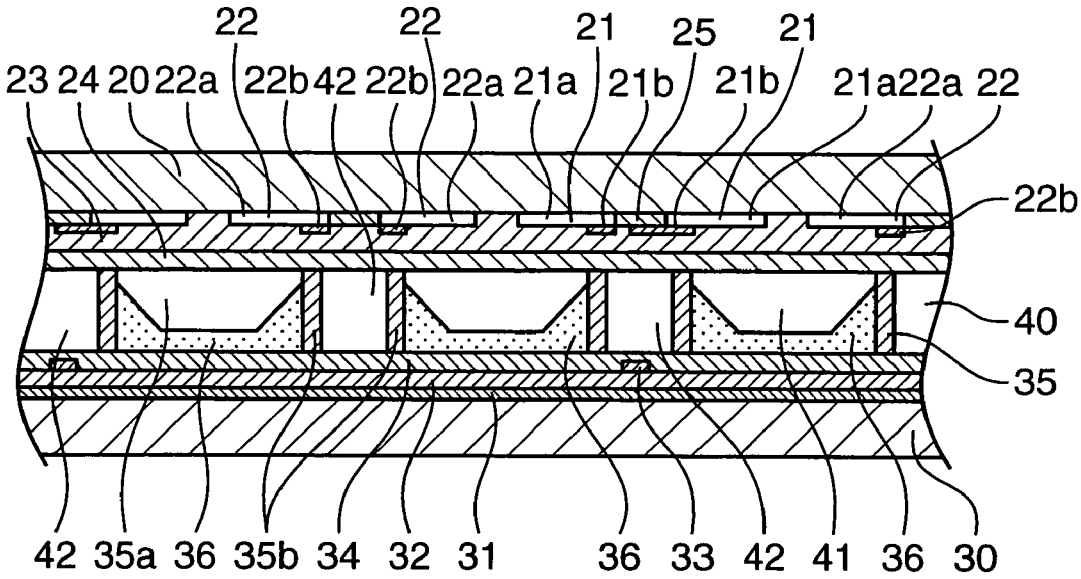
FIG. 2 is a section of a PDP shown in FIG. 1.
Figure 3:
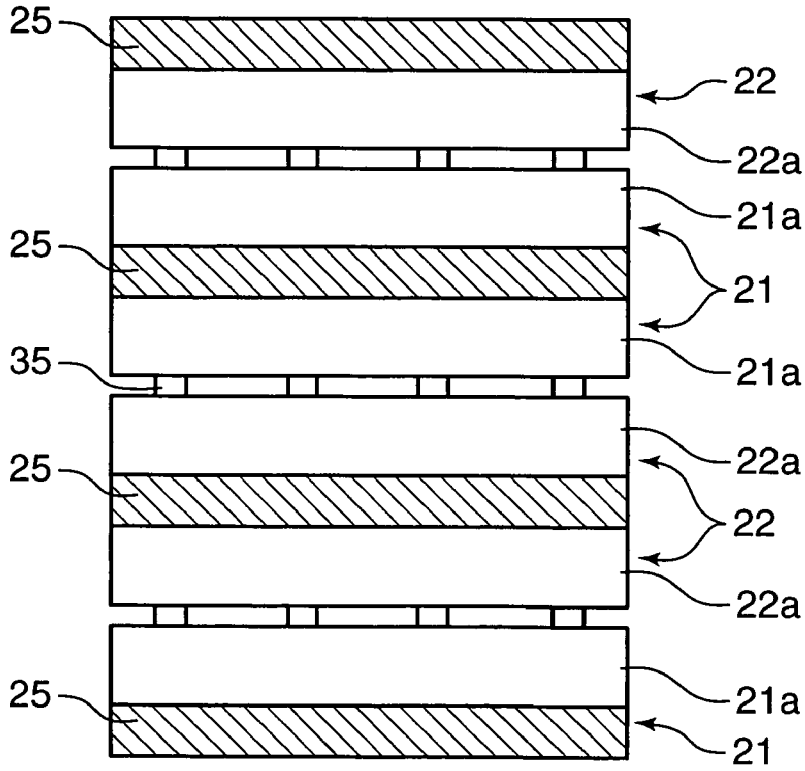
FIG. 3 is a plan view schematically showing an electrode arrangement on a front substrate side of the PDP shown in FIG. 2.
Figure 4:
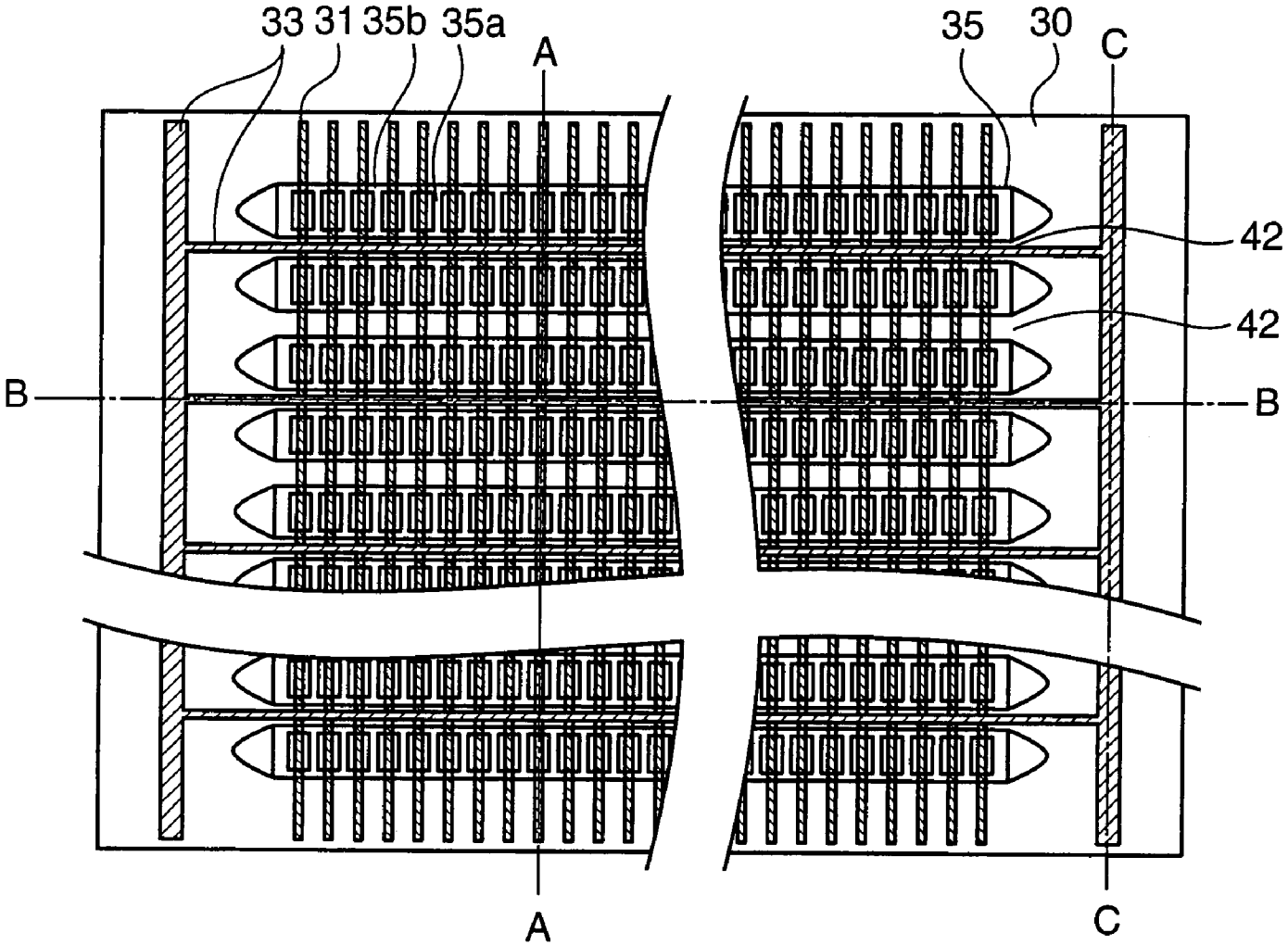
FIG. 4 is a plan view schematically showing a back substrate side of the PDP shown in FIG. 2.
Figure 5:
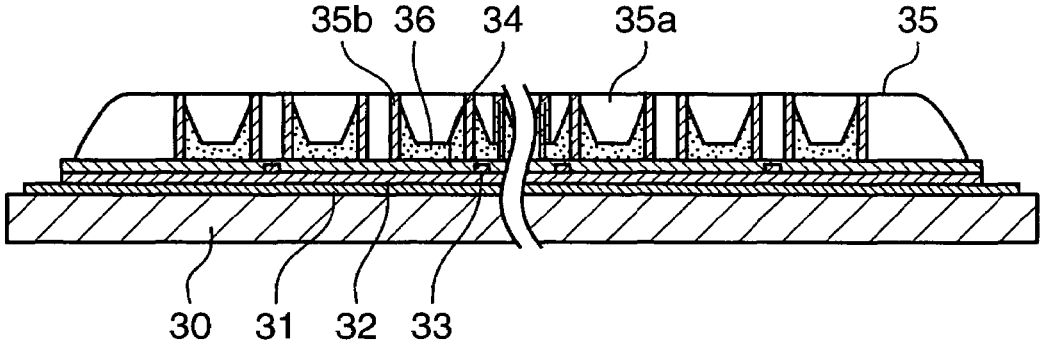
FIG. 5 is a section along A-A of FIG. 4.
Figure 6:
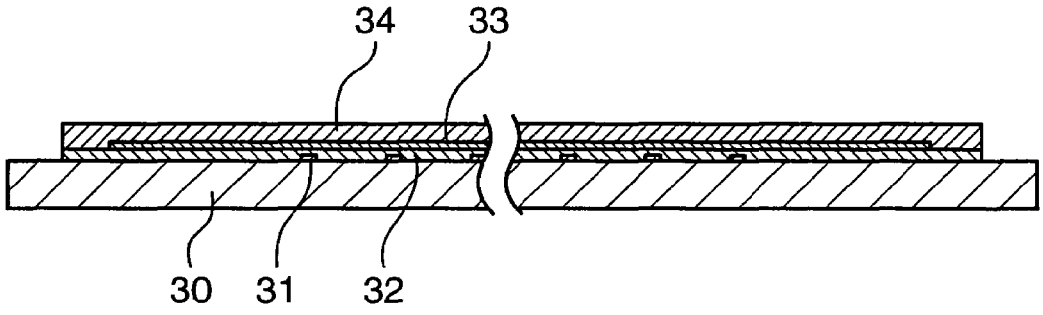
FIG. 6 is a section along B-B of FIG. 4.
Figure 7:
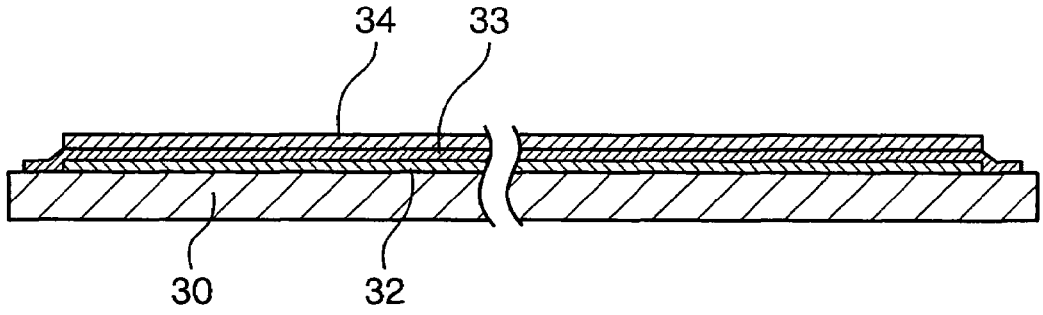
FIG. 7 is a section along C-C of FIG. 4.

Next, the construction of the PDP 1 is described in more detail. FIG. 2 is a section of the PDP shown in FIG. 1; FIG. 3 is a plan view schematically showing an electrode arrangement on a front substrate side of the PDP shown in FIG. 2; FIG. 4 is a plan view schematically showing a back substrate side of the PDP shown in FIG. 2; FIG. 5 is a section along A-A of FIG. 4; FIG. 6 is a section along B-B of FIG. 4; and FIG. 7 is a section along C-C of FIG. 4.

As shown in FIG. 2 and other figures, a glass-made front substrate 20 and a glass-made back substrate 30 are opposed to each other at the opposite sides of a discharge space 40 in the PDP 1, and gas (neon, xenon, etc.) for radiating ultraviolet rays by the discharges is filled into the discharge space 40. A group of electrodes comprised of pairs of strip-shaped scan electrodes 21 and pairs of sustain electrodes 22 and covered by a dielectric layer 23 and a protection film 24 are arrayed in parallel with each other on the front substrate 20. Each scan electrode 21 includes a transparent electrode 21*a* and a metal bus 21*b* formed to be placed on the transparent electrode 21*a* and made of silver or other metal to improve electrical conductivity. Each sustain electrode 22 includes a transparent electrode 22*a* and a metal bus 22*b* formed to be placed on the transparent electrode 22*a* and made of silver or other metal to improve electrical conductivity.

Further, as shown in FIG. 3, the scan electrodes 21 and the sustain electrodes 22 are formed such that an electrode array, in which two scan electrodes and two sustain electrodes are arrayed in this order, serves as one unit, and light absorbing layers 25 made of a black material are provided between adjacent scan electrodes 21 and between adjacent sustain electrodes 22.

On the other hand, as shown in FIG. 2 and other figures, a plurality of strip-shaped data electrodes 31 are arrayed in parallel with each other along a direction normal to the scan electrodes 21 and the sustain electrodes 22 on the back substrate 30. Barrier walls 35 for partitioning a plurality of discharge cells formed by the scan electrodes 21, the sustain electrodes 22 and the data electrodes 31 are formed on the back substrate 30. Phosphor layers 36 formed in correspondence with the discharge cells are provided at sides of cell spaces 41 partitioned by the barrier walls 35 toward the back substrate 30.

As shown in FIG. 4 and other figures, each barrier wall 35 includes vertical wall portions 35*a* and horizontal wall portions 35*b*, wherein the vertical wall portions 35*a* extend in a direction normal to the scan electrodes 21 and the sustain electrodes 22, i.e. a direction parallel with the data electrodes 3, and the horizontal wall portions 35*b* intersect with the vertical wall portions 35*b*. Accordingly, the cell spaces 41 are formed by the vertical wall portions 35*a* and the horizontal wall portions 35*b*, and clearance portions 42 are defined between the cell spaces 41. The above phosphor layers 25 are formed at positions corresponding to spaces of the clearance portions 42 formed between the horizontal wall portions 35*b* of the barrier walls 35.

The priming electrodes 33 for carrying out the priming discharges between the scan electrodes 21 and the priming electrodes 33 in the spaces of the clearance portions 42 are so formed on the side of the back substrate 30 toward the clearance portions 42 as to be opposed to the adjacent scan electrodes 21 and to extent in the direction normal to the data electrodes 31, thereby forming priming cells adjacent to the discharge cells. The priming electrodes 33 are formed on a dielectric layer 32 covering the data electrodes 31 at positions closer to the spaces in the clearance portions 42 than the data electrodes 31.

Each priming electrode 33 is formed only in the clearance portion 42 corresponding to an abutting portion of two scan electrodes 21 to which the write pulses are applied, wherein a part of the metal bus 21*b* of one scan electrode 21 extends toward the clearance portion 42 and is formed on the phosphor layer 25. The priming discharge is carried out between the metal bus 21*b* projecting into the area of the clearance portion 42, out of the two adjacent scan electrodes 21 formed on the front substrate 20, and the priming electrode 33 formed on the back substrate 30.

According to this embodiment, the address driver 2, the scan driver 3, the sustain driver 4, the discharge generating circuit 9, the set-up circuits 10, 11, the priming discharge generating circuit 12 and the priming driver 13 correspond to examples of first to third driving means.

The PDP applicable to the present invention is not particularly limited to the above construction, and various changes can be made as described below as long as the clearance portions are formed between the cell spaces and the priming discharges can be generated in the spaces of the clearance portions between the front substrate and the back substrate. Specifically, a discharge area where the priming discharges are generated between the front substrate and the back substrate may be formed in a portion of the peripheral part of the panel other than the display area. Further, the priming electrodes may be arranged in parallel with the data electrodes, and the priming discharges may be generated between the priming electrodes and the scan electrodes. Furthermore, new priming electrodes may be formed in an area on the front substrate corresponding to the clearance portions in addition to the priming electrodes formed on the back substrate, and the priming discharges may be generated between these priming electrodes.

Figure 8:
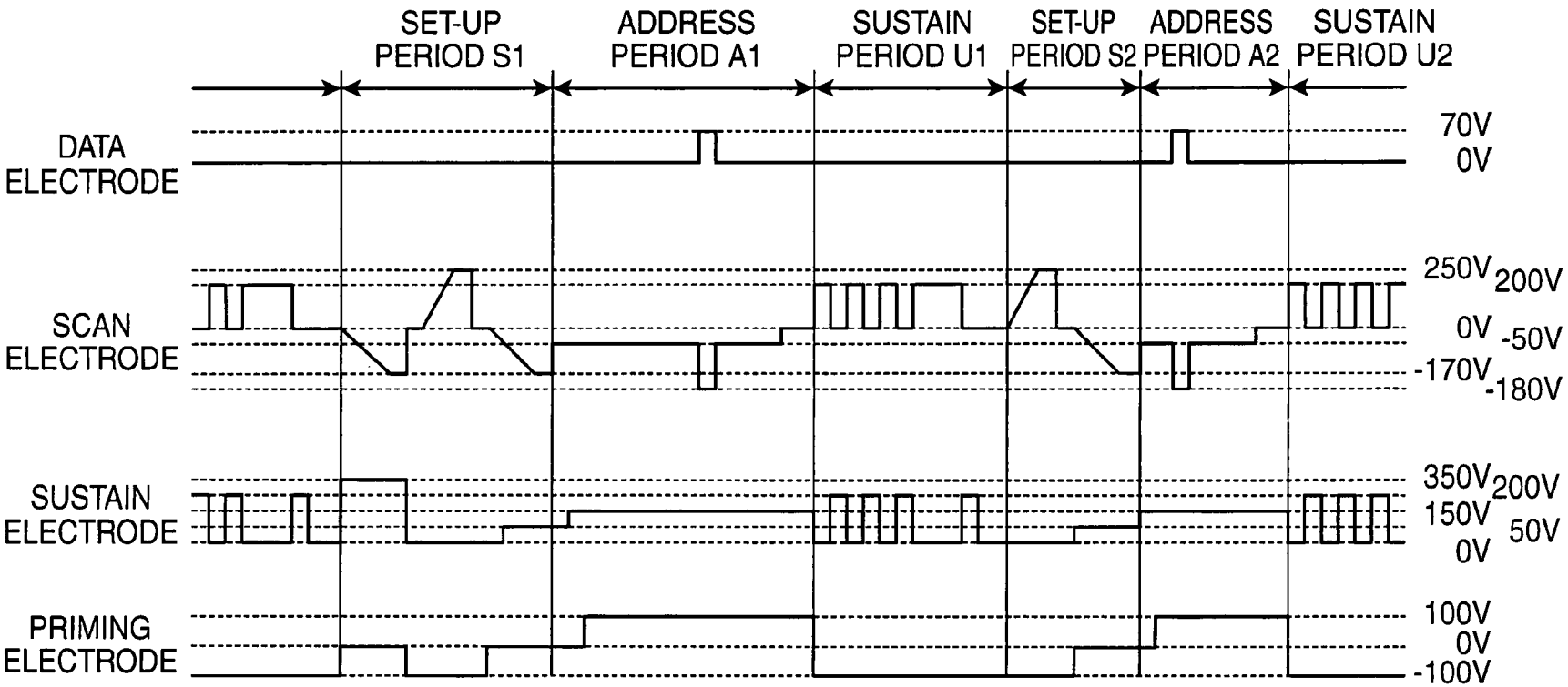
FIG. 8 is a chart showing exemplary drive waveforms of the plasma display apparatus shown in FIG. 1.

Next, the operation of the plasma display apparatus constructed as above is described. FIG. 8 is a chart showing exemplary drive waveforms of the plasma display apparatus shown in FIG. 1. Voltages of respective drive pulses shown in FIG. 8 are only examples, and can be suitably changed in accordance with the discharging characteristic of the PDP 1 and the like. This also holds for other embodiments.

In this embodiment, one field is divided into a plurality of subfields. First set-up period S1, address period A1 and sustain period U1 shown in FIG. 8 correspond to the first subfield, and one each of these periods is given during one vertical synchronization period, i.e. within one field. Succeeding set-up period S2, address period A2 and sustain period U2 correspond to the respective subfields after the first subfield, and the set-up period S2, the address period A2 and the sustain period U2 are repeated in the respective succeeding subfields. It should be noted that the drive waveforms in the sustain periods U1, U2 are basically identical except the number of pulses and the like.

First, in the set-up period S1 of the first subfield, the address driver 2 keeps the data electrodes 31 at 0V. The scan driver 3 sequentially reduces the voltages of the scan electrodes 21 from 0V to −170 V by a ramp waveform and thereafter increases them from −170 V to 0V. The sustain driver 4 applies set-up pulses for vertical synchronization, which are applied once during the vertical synchronization period to increase the voltages of the sustain electrodes 22 from 0V to 350V and holds them at 350V, and reduces them from 350V to 0V when the voltages of the scan electrodes 21 are increased from −170V to 0V, and keeps them at 0V. At this moment, the set-up discharges are generated between the scan electrodes 21, the sustain electrodes 22 and the data electrodes 31 to adjust wall charges, whereby positive charges are uniformly accumulated in the entire surfaces of the scan electrodes 21, negative charges are uniformly accumulated in the entire surfaces of the sustain electrodes 22 and negative charges are uniformly accumulated in the entire surfaces of the data electrodes 31. It should be noted that the voltages of the set-up pulses for vertical synchronization are not particularly limited to 350V, and another voltage may be used within a range of 300V to 350V.

During the set-up period S1 of the first subfield, the priming driver 13 increases the voltages of the priming electrodes 33 from −100V to 0V and keeps them at 0V, and reduces the voltages of the priming electrodes 33 from 0V to −100V when the voltages of the scan electrodes 21 are increased from −170V to 0V, and keeps them at −100V. At this moment, the set-up discharges for adjusting the wall charges are generated between the scan electrodes 21 and the priming electrodes 33 to accumulate positive charges in the priming electrodes 33. Since the voltages of the priming electrodes 33 are increased to and kept at 0V when the voltages of the sustain electrodes 22 are increased to and kept at 350V during the above period, an occurrence, of unnecessary discharges between the sustain electrodes 22 and the priming electrodes 33 can be prevented while stably generating the discharges between the scan electrodes 21 and the sustain electrodes 22. Therefore, inter-electrode interference can be eliminated.

Subsequently, after sequentially increasing the voltages of the scan electrodes 21 from 0V to 250V by a ramp waveform, the scan driver 3 reduces the voltages of the scan electrodes 21 from 250V to 0V and further sequentially reduces them from 0V to −170V by a ramp waveform. The sustain driver 4 increases the voltages of the sustain electrodes 22 from 0V to 50V when the voltages of the scan electrodes 21 are reduced from 0V to −170V by the ramp waveform, and keeps them at 50V. At this moment, weak discharges are generated between the scan electrodes 21 and the sustain electrodes 22, whereby only parts toward the scan electrodes 21 of the positive charges in the sustain electrodes are replaced by negative charges and only parts toward the scan electrodes of the negative charges in the sustain electrodes 22 are replaced by positive charges. Further, the priming driver 13 increases the voltages of the priming electrodes 33 from −100V to 0V and keeps them at 0V at this time.

Since the set-up period S1 given once during the vertical synchronization period is set to be longer than the other set-up periods S2, the wall charges of the respective electrodes can be sufficiently adjusted during the set-up period S1 given once during the vertical synchronization period, thereby enabling the priming discharges thereafter to be more stably generated.

Next, during the address period A1, the scan driver 3 first increases the voltages of the scan electrodes 21 from −170V to −50V and keeps them at −50V and, then, the sustain driver 4 increases the voltages of the sustain electrodes 22 from 50V to 150V and keeps them at 150V. Thereafter, the priming driver 13 increases the voltages of the priming electrodes 33 from 0V to 100V and keeps them at 100V. In this way, the voltages of the priming electrodes 33 are increased to a predetermined voltage after the voltages of the scan electrodes 21 whose wall charges were adjusted were increased to a predetermined voltage. Thus, the priming discharges thereafter can be stably generated. This holds also for the other address periods A2.

Subsequently, the address driver 2 increases the voltages of the data electrodes 31 from 0V to 70V by applying positive write pulses, and the scan driver 3 reduces the voltages of the scan electrodes 21 from −50V to −180V by applying negative write pulses. Then, the priming discharges are generated between the scan electrodes 21 and the priming electrodes 33, and the write discharges are generated between the data electrodes 31 and the scan electrodes 21 utilizing these priming discharges. After the elapse of a predetermined time, the scan driver 3 increases the voltages of the scan electrodes 21 from −50V to 0V and keeps them at 0V.

Figure 9:
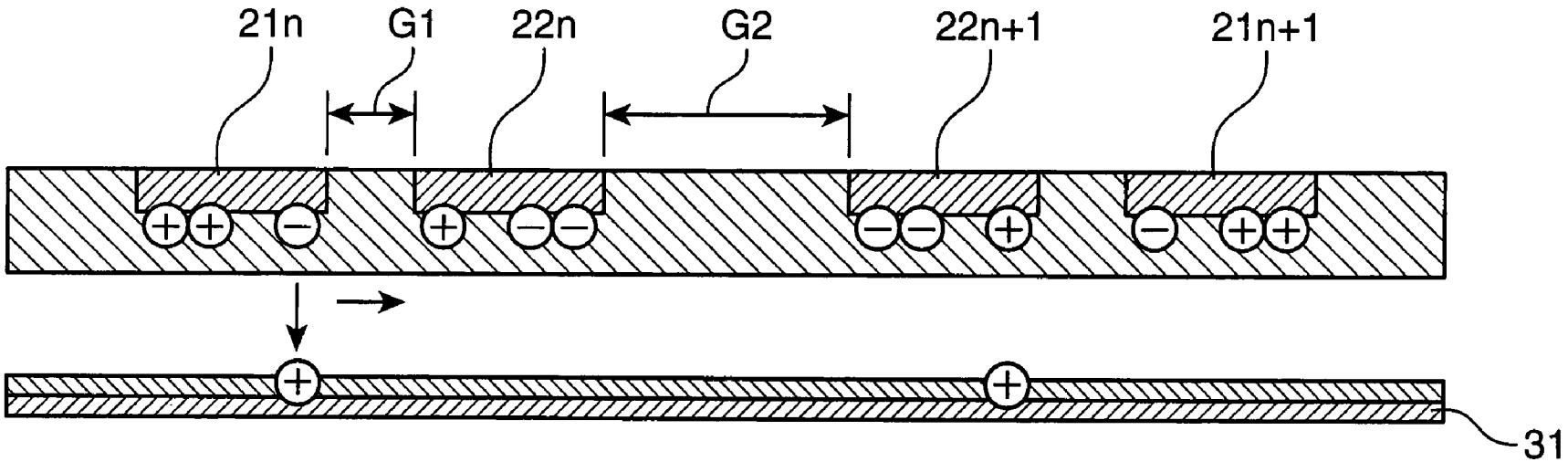
FIG. 9 is a diagram showing write discharges between a data electrode and a scan electrode.

FIG. 9 is a diagram showing the write discharges generated between the data electrode and the scan electrodes. As shown in FIG. 9, prior to the application of the write pulses, negative charges are accumulated only in a part of a scan electrode 21*n* toward a sustain electrode 22*n*, whereas positive charges are accumulated in the other part, i.e. a part of the scan electrode 21*n* toward a scan electrode (not shown). On the other hand, positive charges are accumulated only in a part of the sustain electrode 22*n* toward the scan electrode 21*n*, whereas negative charges are accumulated in the other part, i.e. a part of the sustain electrode 22*n* toward a sustain electrode 22*n*+1. Charges are similarly accumulated in the sustain electrode 22*n*+1 and a scan electrode 21*n*+1.

When the write pulses are applied in this state, a priming discharge is generated between the scan electrode 21*n* and the priming electrode 33 (not shown), and a weak write discharge is generated between the data electrodes 31 and the scan electrode 21*n* utilizing this priming discharge. This weak write discharge triggers a weak discharge between the scan electrode 21*n* and the sustain electrode 22*n*. This discharge between the scan electrode 21*n* and the sustain electrode 22*n* is generated only in the vicinity of a discharge gap G1 between the scan electrode 21*n* and the sustain electrode 22*n*, and a potential barrier wall is formed by electrons in a gap G2 between the sustain electrode 22*n* and the sustain electrode 22*n*+1. Thus, the discharge between the scan electrode 21*n* and the sustain electrode 22*n* can be prevented from spreading toward the sustain electrode 22*n*+1, thereby preventing crosstalk between adjacent lines.

Next, during the sustain period U1, the scan driver 3 sequentially applies sustain pulses of 200V to the scan electrodes 21, and the sustain driver 4 sequentially applies sustaining pulses of 200V, whose phases are shifted by 180° with respect to those given to the scan electrodes 21, to the sustain electrodes 22, thereby causing the sustain discharge to be repeatedly generated by the number of times corresponding to the light emission luminance. Further, the priming driver 13 reduces the voltages of the priming electrodes 33 from 100V to −100V when the first sustain pulses to the scan electrodes 21 rise, and keeps them at −100V. At this moment, discharges are generated between the scan electrodes 21 and the priming electrodes 33 to accumulate positive charges in the priming electrodes 33.

Further, during the sustain period U1, the scan driver 3 applies sustaining pulses having a longer high-period than the other sustaining pulses to the scan electrodes 21 as the last sustaining pulses, and the sustain driver 4 applies last sustaining pulses rising from 0V to 200V to the sustain electrodes 22 when the last sustaining pulses to the scan electrodes 21 fall from 200V to 0V. In this way, the last sustaining pulses to be applied to the sustain electrodes 22 are caused to rise while the last sustaining cycle in the scan electrodes 21 is reduced, whereby strong sustain discharges are generated between the scan electrodes 21 and the sustain electrodes 22 and positive charges are uniformly accumulated in the entire surfaces of the scan electrodes 21 while negative charges are uniformly accumulated in the entire surfaces of the sustain electrodes 22.

During the set-up period S2 of the next subfield, the scan driver 3 reduces the voltages of the scan electrodes 21 from 250V to 0V after sequentially increasing the voltages of the scan electrodes 21 from 0V to 250V by a ramp waveform, and then sequentially reduces them from 0V to −170V by a ramp waveform. The sustain driver 4 increases the voltages of the sustain electrodes 22 from 0V to 50V when the voltages of the scan electrodes 21 are reduced from 0V by a ramp waveform, and keeps them at 0V. At this moment, weak discharges are generated between the scan electrodes 21 and the sustain electrodes 22, whereby only the positive charges in the parts of the scan electrodes 21 toward the sustaining electrodes are replaced by negative charges and only the negative charges in the parts of the sustain electrodes 22 toward the scan electrodes are replaced by positive charges. Further, the priming driver 13 increases the voltages of the priming electrodes 33 from −100V to 0V and keeps them at 0V at this time.

Next, during the address period A2, the scan driver 3 first increases the voltages of the scan electrodes 21 from −170V to −50V and keeps them at −50V, and the sustain driver 4 increases the voltages of the sustain electrodes 22 from 50V to 150V and keeps them at 150V. Thereafter, the priming driver 13 increases the voltages of the priming electrodes 33 from 0V to 100V and keeps them at 100V.

Subsequently, the address driver 2 increases the voltages of the data electrodes 31 from 0V to 70V by applying positive write pulses, and the scan driver 3 reduces the voltages of the scan electrodes 21 from −50V to −180V by applying negative write pulses. Then, priming discharges are generated between the scan electrodes 21 and the priming electrodes 33, and write discharges are generated between the data electrodes 31 and the scan electrodes 21 utilizing these priming discharges. After the elapse of a predetermined time, the scan driver 3 increases the voltages of the scan electrodes 21 from −50V to 0V and keeps them at 0V.

Similar to the address period A1, prior to the application of the write pulses, negative charges are accumulated only in the parts of the scan electrodes 21 toward the sustain electrodes and positive charges are accumulated in the parts of the sustain electrodes 22 toward the scan electrodes in this case as well. When the write pulses are applied in this state, priming discharges are generated between the scan electrodes 21 and the priming electrodes 33, and weak write discharges are generated between the data electrodes 31 and the scan electrodes 21 utilizing these priming discharges. These weak write discharges trigger weak discharges only in the vicinity of the discharge gaps between the scan electrodes 21 and the sustain electrodes 22, and the potential barrier walls are formed by electrons in the gaps between the sustain electrodes 22. This can prevent the discharges between the scan electrodes 21 and the sustain electrodes 22 from spreading toward the adjacent sustain electrodes 22, thereby preventing crosstalk.

Next, during the sustain period U2, operations similar to those during the sustain period U1 are carried out, whereby positive charges are accumulated in the priming electrodes 33, sustain discharges are generated, and positive charges are uniformly accumulated in the entire surfaces of the scan electrodes 21 and negative charges are uniformly accumulated in the entire surfaces of the sustain electrodes 22 by the last sustain discharges. Thereafter, the operations during the set-up period S2, the address period A2 and the sustain period U2 are repeated for each subfield to complete the operations during one field period.

As described above, according to this embodiment, the wall charges of the scan electrodes 21 and the sustain electrodes 22, between which the sustain discharges were generated in the previous subfield, are adjusted during the set-up period. Thus, the wall charges of the scan electrodes 21 having been reduced by the sustain discharges can be replenished, so that the write discharges can be stably generated during the address period. Further, since the write discharges are generated utilizing the priming discharges between the scan electrodes 21 and the priming electrodes 33 during the address period, the write discharges can be stably and weakly generated. Therefore, unnecessary lights due to the write discharges can be reduced and a black luminance in the absence of signals can be sufficiently depressed.

Further, positive charges are accumulated in the entire surfaces of the scan electrodes 21 after the sustain discharges of the scan electrodes 21 having generated the write discharges during the sustain period, and the parts toward the sustain electrodes 22 of positive charges accumulated in the scan electrodes 21 are replaced by negative charges and the parts toward the scan electrodes 21 of negative charges accumulated in the sustain electrodes 22 are replaced by positive charges during the set-up period. Thus, negative charges remain between the adjacent sustain electrodes 22. Accordingly, these negative charges function as potential barrier walls between the adjacent discharge cells, thereby preventing the write discharge during the address period of one discharge cell from spreading toward the other discharge cell. Therefore, crosstalk between the adjacent discharge cells can be sufficiently reduced.

Further, since the partial charge reversal during the set-up period can be caused by a low potential, the set-up circuit 10 and the like can be produced at lower costs.

Figure 10:
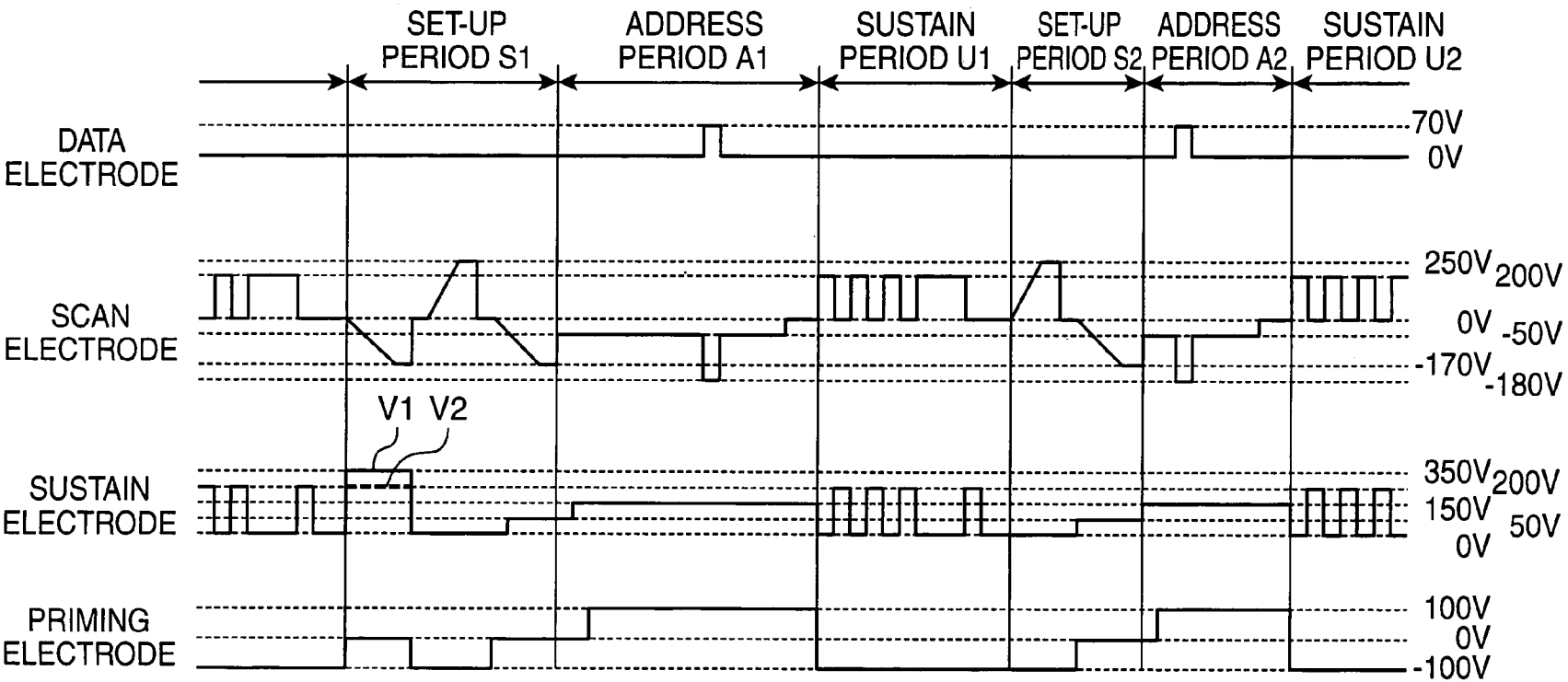
FIG. 10 is a chart showing exemplary drive waveforms of a plasma display apparatus according to a second embodiment of the invention.

Next, a plasma display apparatus according to a second embodiment of the present invention is described. FIG. 10 is a chart showing drive waveforms of the plasma display apparatus according to the second embodiment of the present invention. It should be noted that the construction of the plasma display apparatus of this embodiment is similar to that of the plasma display apparatus shown in FIG. 1 except for drive waveforms applied to the PDP. Thus, the construction of the plasma display apparatus of this embodiment is described with reference to FIG. 1 without being shown. This also applies to the succeeding embodiments.

A point of difference between the drive waveforms shown in FIG. 10 and those shown in FIG. 8 is that the set-up pulses for vertical synchronization are changed. Since these drive waveforms are similar to those shown in FIG. 8 in other points, only the point of difference is described in detail below.

As shown in FIG. 10, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization shown in broken line in FIG. 10 to the sustain electrodes 22.

Since the wall charges are not adjusted at all when the apparatus is turned on, there are cases where the wall charges of the respective electrodes assume abnormal states. Even in such a case, strong set-up discharges can be generated between the scan electrodes 21, the sustain electrodes 22 and the data electrodes 31 by applying the set-up pulses V1 of 350V for vertical synchronization, whereby positive charges are uniformly and stably accumulated in the entire surfaces of the scan electrodes 21, negative charges are uniformly and stably accumulated in the entire surfaces of the sustain electrodes 22 and negative charges can be uniformly and stably accumulated in the entire surfaces of the data electrodes 31.

However, the wall charges are already adjusted in other cases. Thus, the voltages of the set-up pulses for vertical synchronization can be maximally reduced. For example, weak set-up discharges can be stably generated between the scan electrodes 21, the sustain electrodes 22 and the data electrodes 31 by applying the set-up pulses V2 of 200V for vertical synchronization, whereby positive charges are uniformly accumulated in the entire surfaces of the scan electrodes 21, negative charges are uniformly accumulated in the entire surfaces of the sustain electrodes 22 and negative charges can be uniformly accumulated in the entire surfaces of the data electrodes 31.

As described above, according to this embodiment, the weak set-up discharges can be stably generated except for when the apparatus is turned on in addition to the effects of the first embodiment. Thus, a black luminance in the absence of signals can be further reduced, thereby further improving the image quality.

The application timing of the high-potential set-up pulses V1 for vertical synchronization is not particularly limited only to the turning-on timing of the apparatus. High-potential set-up pulses V1 for vertical synchronization may also be applied upon an abnormal situation other than normal image displaying periods such as when the input of video signals is switched or when the channel is switched.

Figure 11:
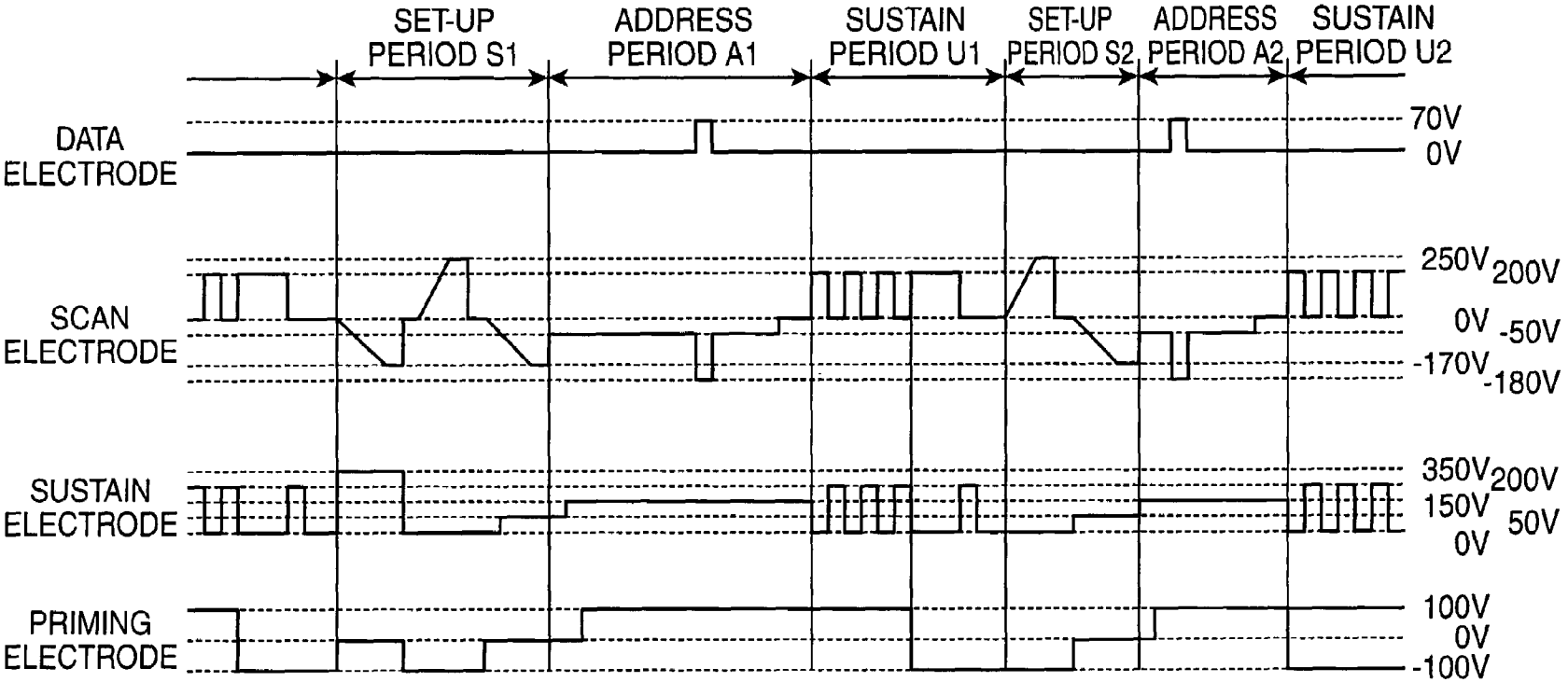
FIG. 11 is a chart showing exemplary drive waveforms of a plasma display apparatus according to a third embodiment of the invention.

Next, a plasma display apparatus according to a third embodiment of the present invention is described. FIG. 11 is a chart showing drive waveforms of the plasma display apparatus according to the third embodiment of the present invention.

A point of difference between the drive waveforms shown in FIG. 11 and those shown in FIG. 8 is that the pulses to be applied to the priming electrodes 33 are changed. Since these drive waveforms are similar to those shown in FIG. 8 in other points, only the point of difference is described in detail below.

As shown in FIG. 11, during the sustain period U1, the priming driver 13 reduces the voltages of the priming electrodes 33 from 100V to −100V when the last sustain pulses to the scan electrodes 21 rise, and keeps them at −100V. At this moment, discharges are generated between the scan electrodes 21 and the priming electrodes 33 to accumulate positive charges in the priming electrodes 33. In this case, since a time up to the succeeding set-up period S2 after the adjustment of the wall charges can be shortened, the priming effect by the discharges between the scan electrodes 21 and the priming electrodes 33 can be utilized in the set-up discharges during the succeeding set-up period S2.

As described above, according to the this embodiment, the priming effect by the discharges between the scan electrodes 21 and the priming electrodes 33 can be utilized in the set-up discharges during the succeeding set-up period S2, in addition to the effects of the first embodiment. Thus, even if the set-up discharges are weak, they can be stably generated, whereby the black luminance can be reduced by reducing unnecessary lights during the set-up periods, and the write discharges can also be stably generated.

Figure 12:
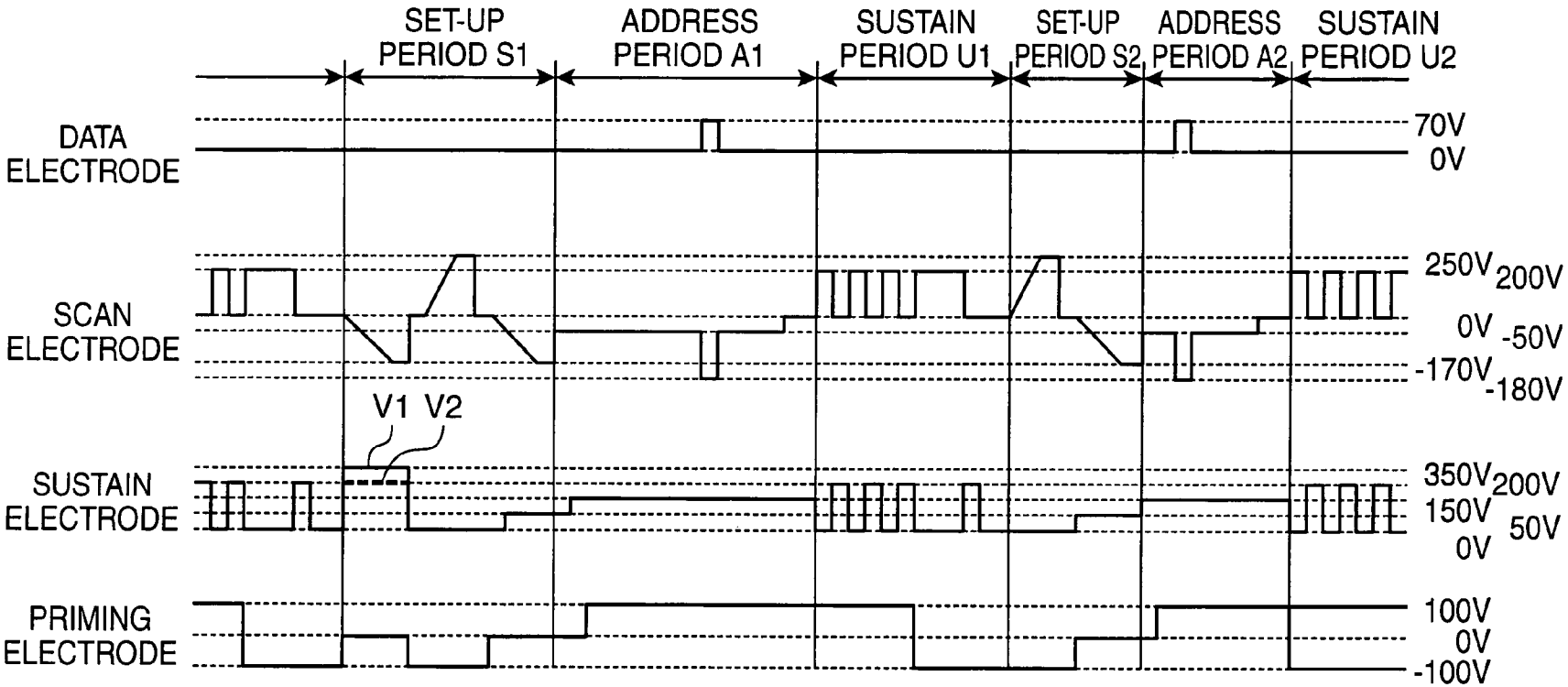
FIG. 12 is a chart showing exemplary drive waveforms of a plasma display apparatus according to a fourth embodiment of the invention.

Next, a plasma display apparatus according to a fourth embodiment of the present invention is described. FIG. 12 is a chart showing drive waveforms of the plasma display apparatus according to the fourth embodiment of the present invention.

A point of difference between the drive waveforms shown in FIG. 12 and those shown in FIG. 8 is that the set-up pulses for vertical synchronization and the pulses to be applied to the priming electrodes 33 are changed. Since these drive waveforms are similar to those shown in FIG. 8 in other points, only the point of difference is described in detail below.

As shown in FIG. 12, similar to the second embodiment, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization to the sustain electrodes 22.

Further, similar to the third embodiment, during the sustain period U1, the priming driver 13 reduces the voltages of the priming electrodes 33 from 100V to −100V when the last sustain pulses to the scan electrodes 21 rise, whereby discharges are generated between the scan electrodes 21 and the priming electrodes 33 to accumulate positive charges in the priming electrodes 33. Accordingly, in this embodiment, the effects of the second and third embodiments can be obtained in addition to those of the first embodiment.

Figure 13:
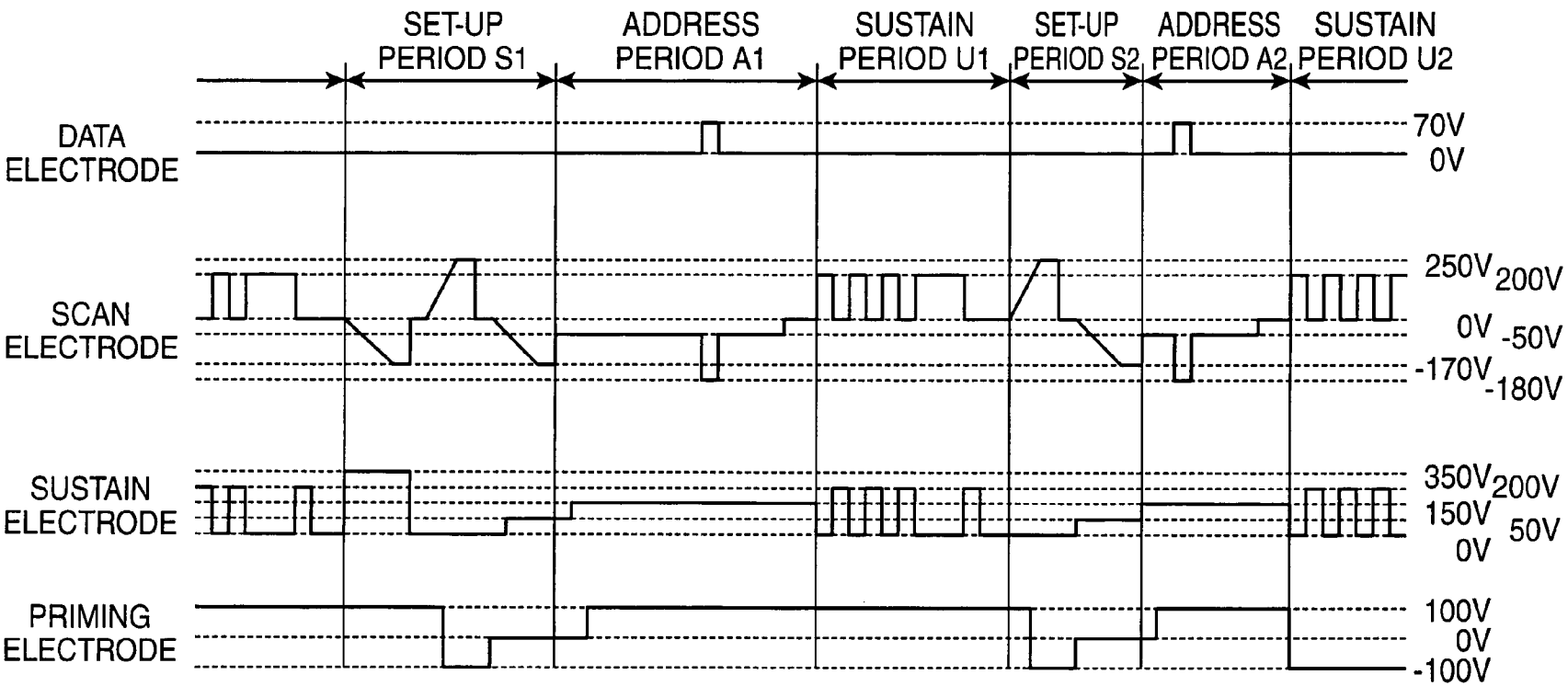
FIG. 13 is a chart showing exemplary drive waveforms of the plasma display apparatus according to a fifth embodiment of the invention.

Next, a plasma display apparatus according to a fifth embodiment of the present invention is described. FIG. 13 is a chart showing drive waveforms of the plasma display apparatus according to the fifth embodiment of the present invention.

A point of difference between the drive waveforms shown in FIG. 13 and those shown in FIG. 8 is that the pulses to be applied to the priming electrodes 33 are changed. Since these drive waveforms are similar to those shown in FIG. 8 in other points, only the point of difference is described in detail below.

As shown in FIG. 13, during the set-up periods S1, S2, the priming driver 13 keeps the voltages of the priming electrodes 33 at 100V, and reduces the voltages of the priming electrodes 33 from 100V to −100V and keeps them at −100V while the voltages of the scan electrodes 21 are increased from 0V to 250V by a ramp waveform. At this moment, discharges are generated between the scan electrodes 21 and the priming electrodes 33 to accumulate positive charges in the priming electrodes 33.

Subsequently, the scan driver 3 reduces the voltages of the scan electrodes 21 from 250V to 0V and further sequentially reduces them from 0V to −170V by a ramp waveform. The sustain driver 4 increases the voltages of the sustain electrodes 22 from 0V to 50V and keeps them at 50V while the voltages of the scan electrodes 21 are reduced from 0V to −170V by the ramp waveform. At this time, the priming effect by the discharges between the scan electrodes 21 and the priming electrodes 33 is utilized to stably generate weak discharges between the scan electrodes 21 and the sustain electrodes 22, whereby only parts toward the sustain electrodes of positive charges in the scan electrodes 21 are replaced by negative charges and only parts toward the scan electrodes of negative charges in the sustain electrodes 22 are replaced by positive charges.

As described above, in this embodiment, the discharges between the scan electrodes 21 and the priming electrodes 33 are generated before the discharges between the scan electrodes 21 and the sustain electrodes 22 to adjust the wall charges of the priming electrodes 33 during the set-up periods. Thus, in addition to the effects of the first embodiment, the priming effect by the discharges between the scan electrodes 21 and the priming electrodes 33 can be utilized in the set-up discharges between the scan electrodes 21 and the sustain electrodes 22, enabling the set-up discharges to be stably generated even if the set-up discharges are weak. Therefore, unnecessary lights during the set-up periods can be reduced to further reduce the black luminance, and the write discharges can also be stably generated.

Figure 14:
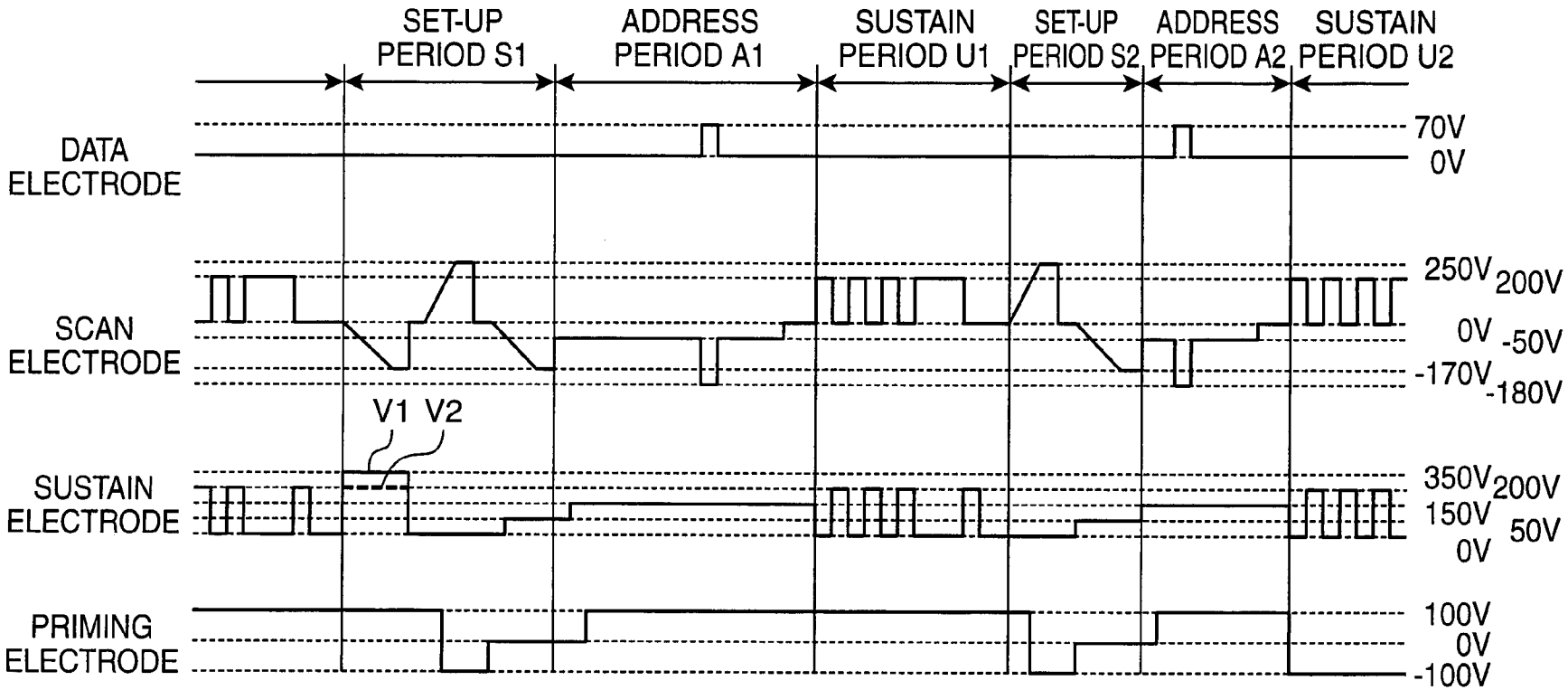
FIG. 14 is a chart showing exemplary drive waveforms of the plasma display apparatus according to a sixth embodiment of the invention.

Next, a plasma display apparatus according to a sixth embodiment of the present invention is described. FIG. 14 is a chart showing drive waveforms of the plasma display apparatus according to the sixth embodiment of the present invention.

A point of difference between the drive waveforms shown in FIG. 14 and those shown in FIG. 8 is that the set-up pulses for vertical synchronization and the pulses to be applied to the priming electrodes 33 are changed. Since these drive waveforms are similar to those shown in FIG. 8 in other points, only the point of difference is described in detail below.

As shown in FIG. 14, similar to the second embodiment, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization to the sustain electrodes 22.

Further, similar to the fifth embodiment, during the set-up periods S1, S2, the priming driver 13 reduces the voltages of the priming electrodes 33 from 100V to −100V and keeps them at −100V while the voltages of the scan electrodes 21 are increased by a ramp waveform, thereby generating discharges between the scan electrodes 21 and the priming electrodes 33 to accumulate positive charges in the priming electrodes 33. Subsequently, while the scan driver 3 reduces the voltages of the scan electrodes 21 by a ramp waveform, the sustain driver 4 increases the voltages of the sustain electrodes 22. The priming effect by the discharges between the scan electrodes 21 and the priming electrodes 33 is utilized to stably generate weak discharges between the scan electrodes 21 and the sustain electrodes 22, whereby only parts toward the sustain electrodes of positive charges in the scan electrodes 21 are replaced by negative charges and only parts toward the scan electrodes of negative charges in the sustain electrodes 22 are replaced by positive charges. Accordingly, in this embodiment, the effects of the second and fifth embodiment can be obtained in addition to those of the first embodiment.

Figure 15:
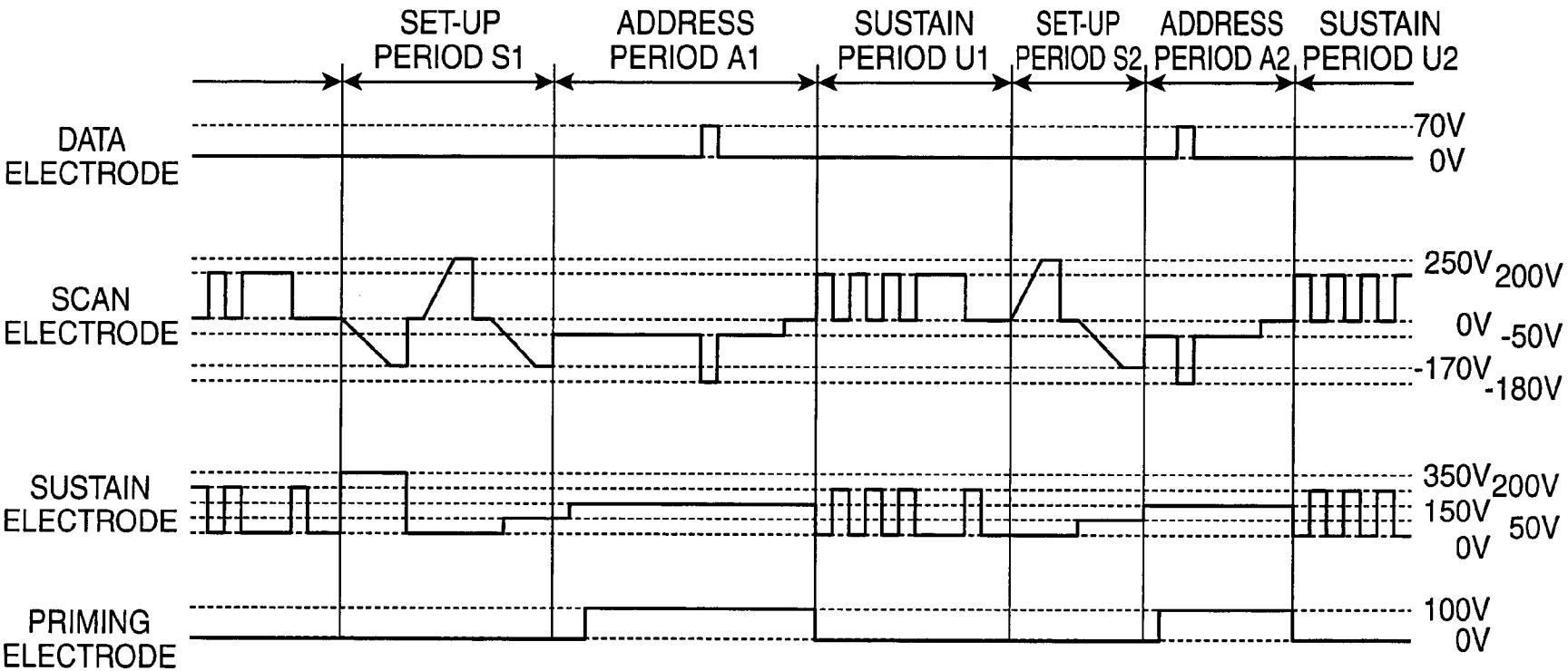
FIG. 15 is a chart showing exemplary drive waveforms of a plasma display apparatus according to a seventh embodiment of the invention.

Next, a plasma display apparatus according to a seventh embodiment of the present invention is described. FIG. 15 is a chart showing drive waveforms of the plasma display apparatus according to the seventh embodiment of the present invention.

A point of difference between the drive waveforms shown in FIG. 15 and those shown in FIG. 8 is that the pulses to be applied to the priming electrodes 33 are changed. Since these drive waveforms are similar to those shown in FIG. 8 in other points, only the point of difference is described in detail below.

As shown in FIG. 15, the priming driver 13 keeps the voltages of the priming electrodes 33 at 0V during the set-up periods S1, S2; increases them from 0V to 100V and keeps them at 100V during the address periods A1, A2; and reduces them from 100V to 0V when the first sustain pulses to the scan electrodes 21 rise and keeps them at 0V during the sustain periods U1, U2. At this time, discharges are generated between the scan electrodes 21 and the priming electrodes 33 to accumulate positive charges in the priming electrodes 33.

As described above, in this embodiment, since the voltages applied to the priming electrodes 33 take two values of 0V and 100V, effects of being able to simplify the construction of the priming driver 13 and to reduce the power consumption and electromagnetic wave interference can be obtained in addition to those of the first embodiment.

Figure 16:
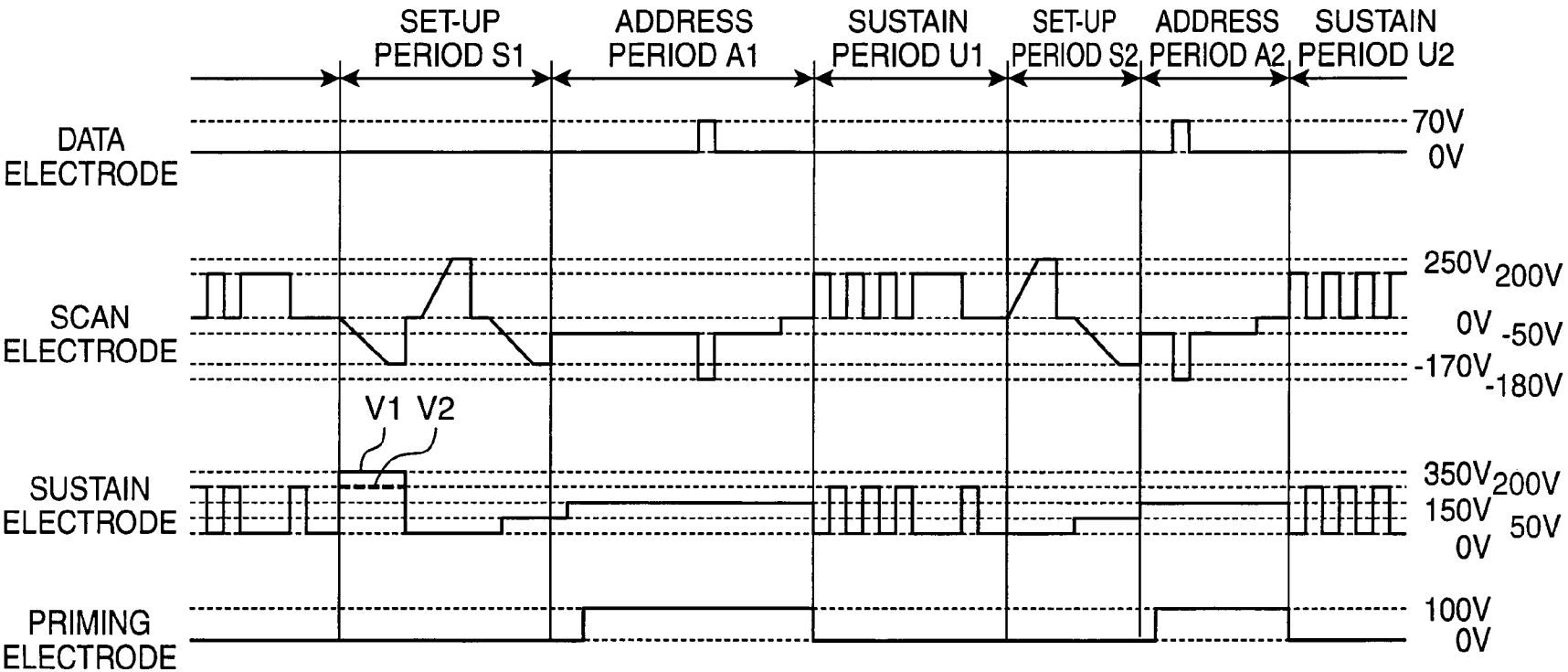
FIG. 16 is a chart showing exemplary drive waveforms of a plasma display apparatus according to an eighth embodiment of the invention.

Next, a plasma display apparatus according to an eighth embodiment of the present invention is described. FIG. 16 is a chart showing drive waveforms of the plasma display apparatus according to the eighth embodiment of the present invention.

A point of difference between the drive waveforms shown in FIG. 16 and those shown in FIG. 8 is that the set-up pulses for vertical synchronization and the pulses to be applied to the priming electrodes 33 are changed. Since these drive waveforms are similar to those shown in FIG. 8 in other points, only the point of difference is described in detail below.

As shown in FIG. 16, similar to the second embodiment, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization to the sustain electrodes 22.

Further, similar to the seventh embodiment, the priming driver 13 keeps the voltages of the priming electrodes 33 at 0V during the set-up periods S1, S2; increases them from 0V to 100V and keeps them at 100V during the address periods A1, A2; and reduces them from 100V to 0V when the first sustain pulses to the scan electrodes 21 rise and keeps them at 0V during the sustain periods U1, U2, thereby generating discharges between the scan electrodes 21 and the priming electrodes 33 to accumulate positive charges in the priming electrodes 33. Accordingly, in this embodiment, the effects of the second and seventh embodiments can be obtained in addition to those of the first embodiment.

Figure 17:
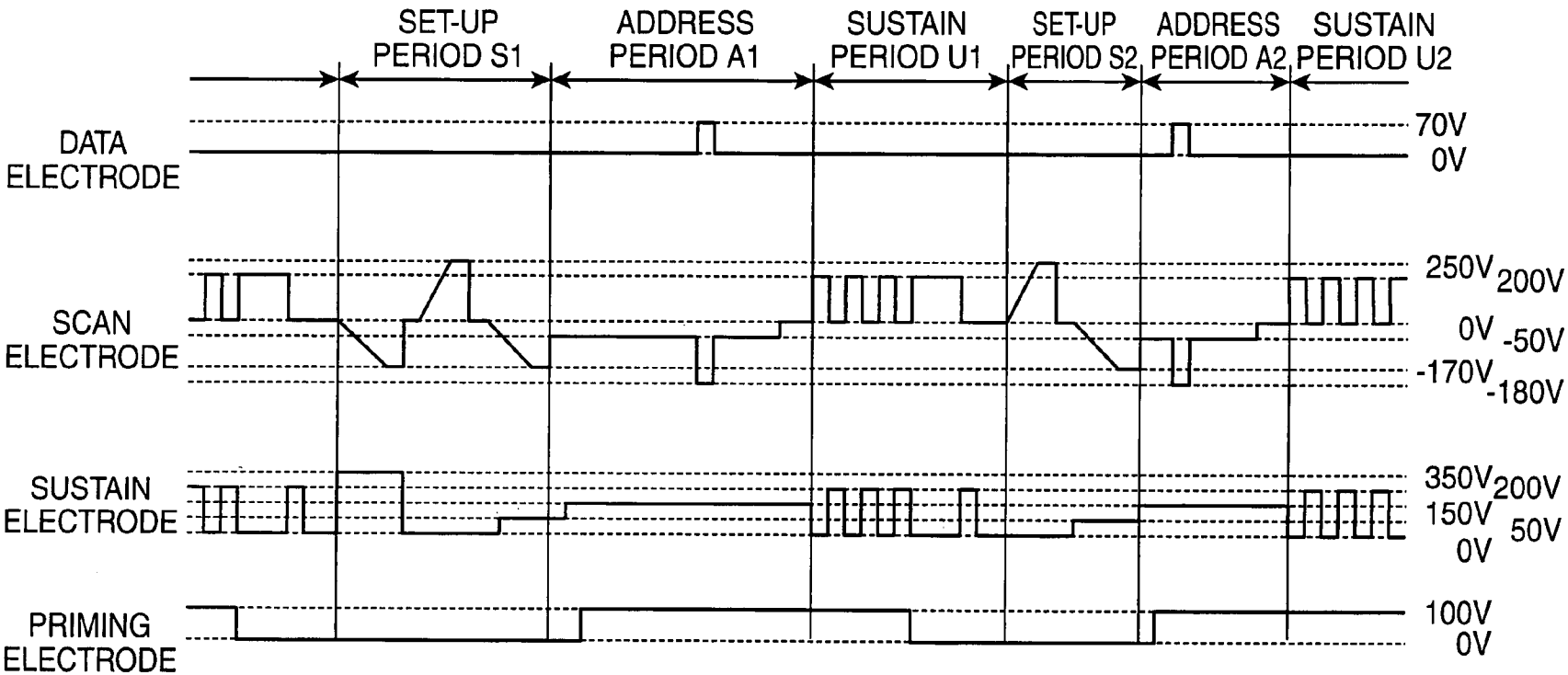
FIG. 17 is a chart showing exemplary drive waveforms of a plasma display apparatus according to a ninth embodiment of the invention.

Next, a plasma display apparatus according to a ninth embodiment of the present invention is described. FIG. 17 is a chart showing drive waveforms of the plasma display apparatus according to the ninth embodiment of the present invention.

A point of difference between the drive waveforms shown in FIG. 17 and those shown in FIG. 8 is that the pulses to be applied to the priming electrodes 33 are changed. Since these drive waveforms are similar to those shown in FIG. 8 in other points, only the point of difference is described in detail below.

As shown in FIG. 17, the priming driver 13 keeps the voltages of the priming electrodes 33 at 0V during the set-up periods S1, S2; increases them from 0V to 100V and keeps them at 100V during the address periods A1, A2; and reduces them from 100V to 0V when the first sustain pulses to the scan electrodes 21 rise and keeps them at 0V during the sustain periods U1, U2 similar to the third embodiment. At this moment, discharges are generated between the scan electrodes 21 and the priming electrodes 33 to accumulate positive charges in the priming electrodes 33.

As described above, since the voltages applied to the priming electrodes 33 take two values of 0V and 100V according to this embodiment, effects of being able to simplify the construction of the priming driver 13 and to reduce the power consumption and electromagnetic wave interference can be obtained in addition to those of the first and third embodiments.

Figure 18:
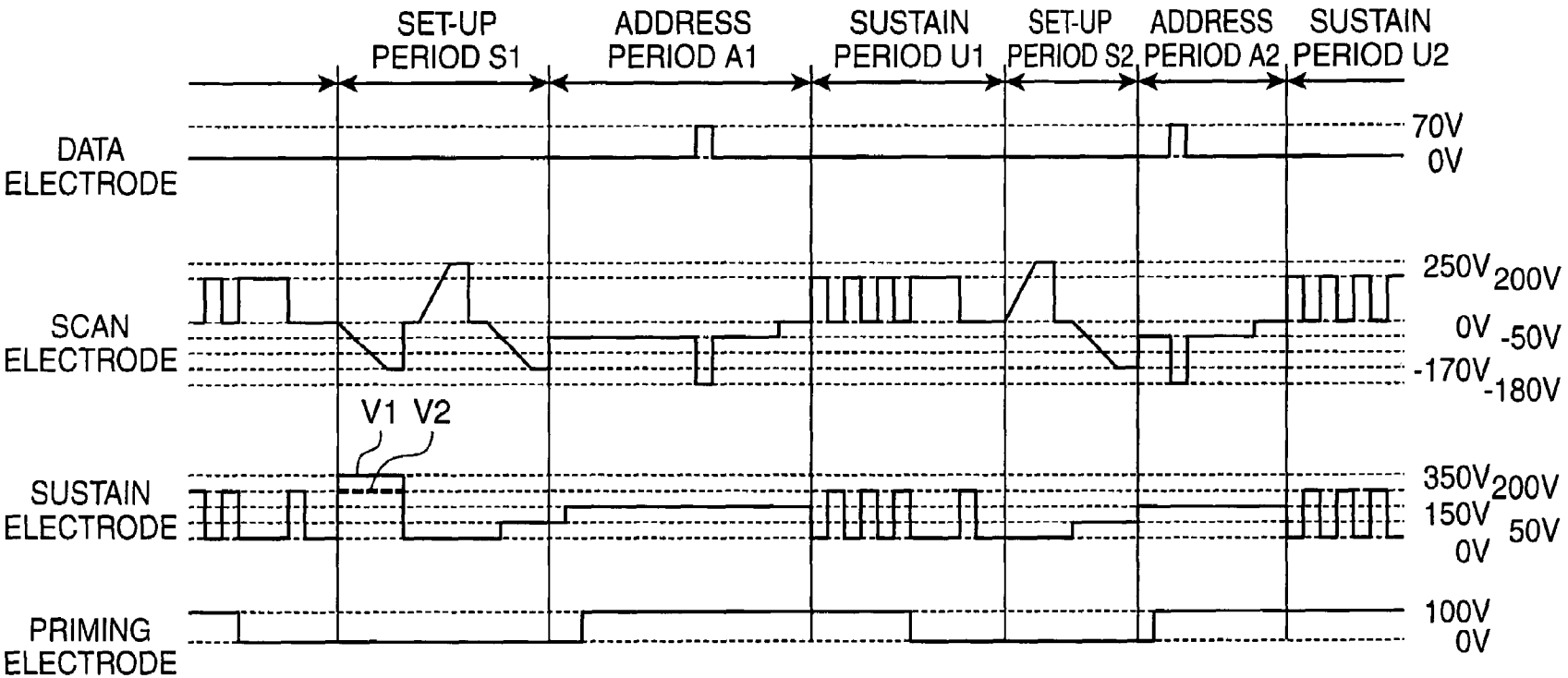
FIG. 18 is a chart showing exemplary drive waveforms of a plasma display apparatus according to a tenth embodiment of the invention.

Next, a plasma display apparatus according to a tenth embodiment of the present invention is described. FIG. 18 is a chart showing drive waveforms of the plasma display apparatus according to the tenth embodiment of the present invention.

A point of difference between the drive waveforms shown in FIG. 18 and those shown in FIG. 8 is that the set-up pulses for vertical synchronization and the pulses to be applied to the priming electrodes 33 are changed. Since these drive waveforms are similar to those shown in FIG. 8 in other points, only the point of difference is described in detail below.

As shown in FIG. 18, similar to the second embodiment, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization to the sustain electrodes 22.

Further, similar to the ninth embodiment, the priming driver 13 keeps the voltages of the priming electrodes 33 at 0V during the set-up periods S1, S2; increases them from 0V to 100V and keeps them at 100V during the address periods A1, A2; and reduces them from 100V to 0V when the first sustain pulses to the scan electrodes 21 rise and keeps them at 0V during the sustain periods U1, U2. At this moment, discharges are generated between the scan electrodes 21 and the priming electrodes 33 to accumulate positive charges in the priming electrodes 33. Accordingly, in this embodiment, the effects of the second and ninth embodiments can be obtained in addition to those of the first embodiment.

Figure 19:
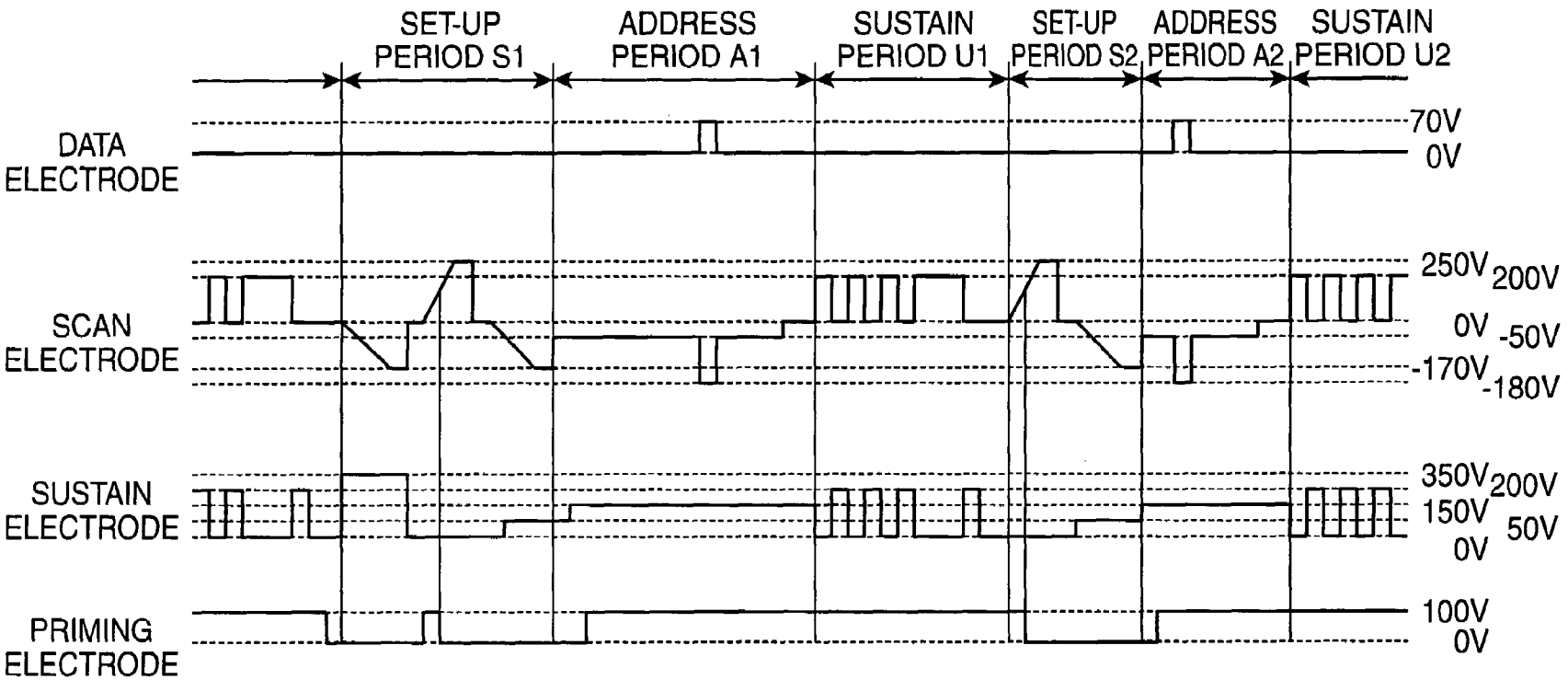
FIG. 19 is a chart showing exemplary drive waveforms of a plasma display apparatus according to an eleventh embodiment of the invention.

Next, a plasma display apparatus according to an eleventh embodiment of the present invention is described. FIG. 19 is a chart showing drive waveforms of the plasma display apparatus according to the eleventh embodiment of the present invention.

A point of difference between the drive waveforms shown in FIG. 19 and those shown in FIG. 8 is that the pulses to be applied to the priming electrodes 33 are changed. Since these drive waveforms are similar to those shown in FIG. 8 in other points, only the point of difference is described in detail below.

As shown in FIG. 19, during the set-up period S1, the priming driver 13 keeps the voltages of the priming electrodes 33 at 0V, increases them from 0V to 100V and keeps them at 100V for a predetermined time while the voltages of the scan electrodes 21 are increased from 0V to 250V by a ramp waveform, and then reduces them from 100V to 0V and keeps them at 0V. In this case, discharges are generated between the scan electrodes 21 and the priming electrodes 33 to accumulate positive charges in the priming electrodes 33 when the voltages of the priming electrodes 33 increase from 0V to 100V.

Subsequently, the scan driver 3 reduces the voltages of the scan electrodes 21 from 250V to 0V and further sequentially reduces from 0V to −170V by a ramp waveform. The sustain driver 4 increases the voltages of the sustain electrodes 22 from 0V to 150V and keeps them at 150V while the voltages of the scan electrodes 21 are reduced from 0V to −170V by the ramp waveform. At this moment, weak discharges are stably generated between the scan electrodes 21 and the sustain electrodes 22, utilizing the priming effect by the discharges between the scan electrodes 21 and the priming electrodes 33, whereby only parts toward the sustain electrodes of positive charges in the scan electrodes 21 are replaced by negative charges and only parts toward the scan electrodes of negative charges in the sustain electrodes 22 are replaced by positive charges.

Subsequently, the priming driver 13 increases the voltages of the priming electrodes 33 from 0V to 100V and keeps them at 100V during the address period A1, and reduces them from 100V to 0V and keeps them at 0V during the set-up period S1 after the elapse of the sustain period U1 while the voltages of the scan electrodes 21 are increased from 0V to 250V by a ramp waveform. In this case as well, discharges are generated between the scan electrodes 21 and the priming electrodes 33 to accumulate positive charges in the priming electrodes 33 when the voltages of the priming electrodes 33 are reduced from 100V to 0V. Thereafter, operations similar to those during the address period A1 and the sustain period U1 are carried out during the address periods A2 and the sustain periods U2.

As described above, according to this embodiment, the following effects can be obtained in addition to those of the first embodiment since the priming effect by the discharges between the scan electrodes 21 and the priming electrodes 33 can be utilized in the set-up discharges between the scan electrodes 21 and the sustain electrodes 22. Even if the set-up discharges are weak discharges, the black luminance can be reduced by reducing unnecessary lights during the set-up periods, and the write discharges can also be stably generated. Further, since the voltages applied to the priming electrodes 33 take two values of 0V and 100V, the construction of the priming driver 13 can be simplified and the power consumption and electromagnetic wave interference can be reduced.

Figure 20:
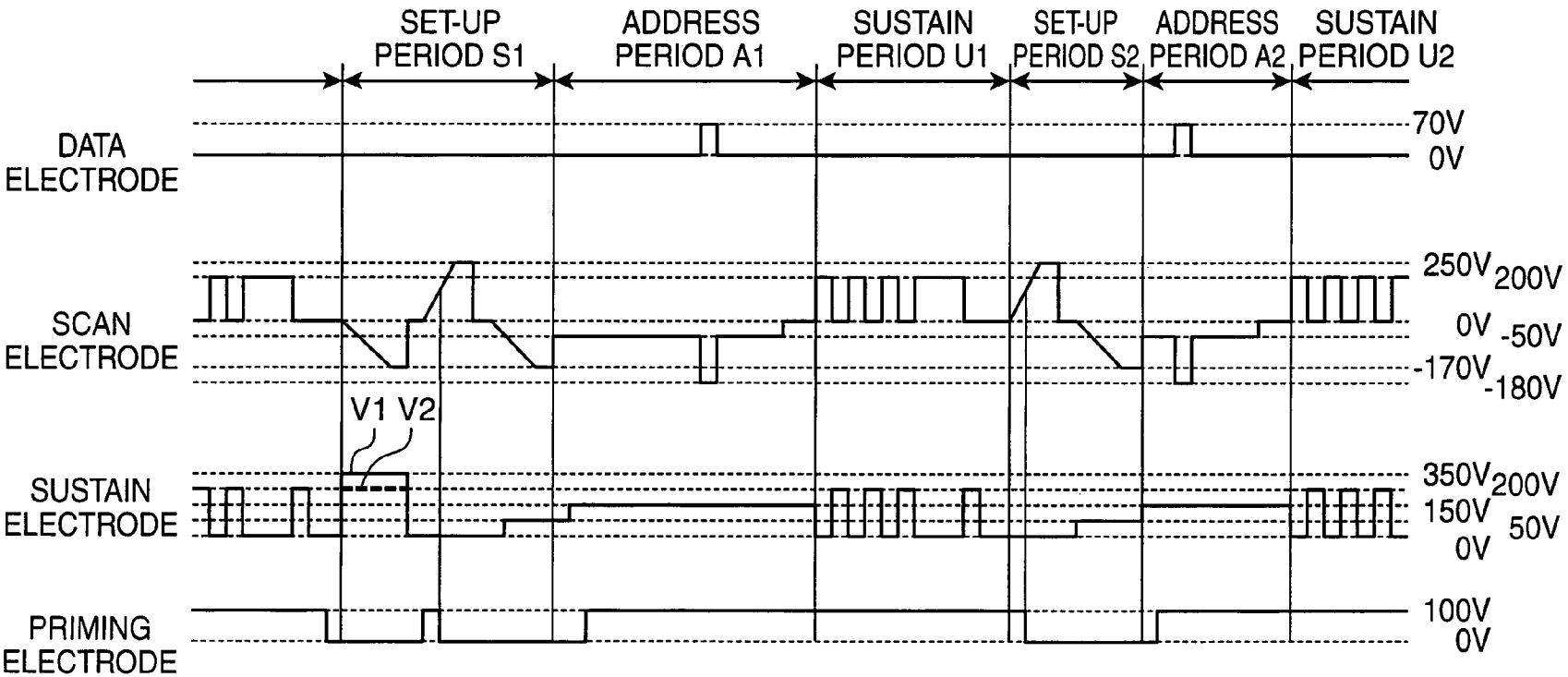
FIG. 20 is a chart showing exemplary drive waveforms of a plasma display apparatus according to a twelfth embodiment of the invention.

Next, a plasma display apparatus according to a twelfth embodiment of the present invention is described. FIG. 20 is a chart showing drive waveforms of the plasma display apparatus according to the twelfth embodiment of the present invention.

A point of difference between the drive waveforms shown in FIG. 20 and those shown in FIG. 8 is that the set-up pulses for vertical synchronization and the pulses to be applied to the priming electrodes 33 are changed. Since these drive waveforms are similar to those shown in FIG. 8 in other points, only the point of difference is described in detail below.

As shown in FIG. 20, similar to the second embodiment, during the set-up period S1 of the first subfield, the sustain driver 4 applies set-up pulses V1 of 350V for vertical synchronization to the sustain electrodes 22 when the plasma display apparatus is turned on, and thereafter applies set-up pulses V2 of 200V for vertical synchronization to the sustain electrodes 22.

Further, similar to the eleventh embodiment, during the set-up periods S1, S2, discharges are generated between the scan electrodes 21 and the priming electrodes 33 to accumulate positive charges in the priming electrodes 33 when the voltages of the priming electrodes 33 are reduced from 100V to 0V. The priming effect by the discharges between the scan electrodes 21 and the priming electrodes 33 is utilized to stably generate weak discharges between the scan electrodes 21 and the sustain electrodes 22, whereby only parts toward the sustain electrodes of positive charges in the scan electrodes 21 are replaced by negative charges and only parts toward the scan electrodes of negative charges in the sustain electrodes 22 are replaced by positive charges. Accordingly, in this embodiment, the effects of the second and eleventh embodiments can be obtained in addition to those of the first embodiment.

Although the division into subfields by the ADS method is described as an example in the foregoing embodiments, the present invention is similarly applicable and similar effects can be obtained even if another subfield method such as division into subfields by an address display simultaneous driving method.

INDUSTRIAL APPLICABILITY

As described above, the present invention can sufficiently reduce the crosstalk and sufficiently reduce the black luminance in the absence of signals, and is suitably applicable to a plasma display apparatus or the like for displaying images in gradation by dividing one field into a plurality of subfields.

What is claimed is:

1. A plasma display apparatus for displaying images in gradation while dividing one field into a plurality of subfields each including a set-up period, an address period and a sustain period, comprising:

an AC plasma display panel formed with a plurality of scan electrodes and a plurality of sustain electrodes, an electrode array comprised of two scan electrodes and two sustain electrodes arrayed in this order being one unit, a plurality of priming electrodes each opposed to an adjacent scan electrode, and a plurality of data electrodes extending in such a direction as to cross the scan electrodes and the sustain electrodes, first driving means for adjusting wall charges of the scan electrodes and the sustain electrodes, between which sustain discharges were generated in the previous subfield, during each set-up period, second driving means for, during each address period, applying write pulses to the scan electrodes having the wall charges thereof adjusted by the first driving means to generate priming discharges between the scan electrodes and the priming electrodes, and applying write pulses to the data electrodes to generate write discharges utilizing the priming discharges, and third driving means for, during each sustain period, causing sustain discharges to be generated between the scan electrodes caused to generate the write discharges by the second driving means and the sustain electrodes to accumulate positive charges in the scan electrodes and negative charges in the sustain electrodes after the sustain discharges, wherein the first driving means replaces parts toward the sustain electrodes of the positive charges in the scan electrodes accumulated by the third driving means by negative charges and replaces parts toward the scan electrodes of the negative charges in the sustain electrodes accumulated by the third driving means by positive charges.

2. A plasma display apparatus according to claim 1, wherein the third driving means makes the pulse duration of the last sustain pulses applied to the scan electrodes shorter than those of other sustain pulses.

3. A plasma display apparatus according to claim 1, wherein the first driving means applies set-up pulses for vertical synchronization applied once during a vertical synchronization period at a first voltage to the sustain electrodes at least when the display apparatus is turned on, and applies the set-up pulses for vertical synchronization thereto at a second voltage lower than the first voltage in other cases.

4. A plasma display apparatus according to claim 1, wherein the third driving means causes the discharges to be generated between the scan electrodes and the priming electrodes by the last sustain pulses applied to the scan electrodes during each sustain period, thereby adjusting the wall charges of the priming electrodes.

5. A plasma display apparatus according to claim 1, wherein:

the first driving means keeps the voltages of the priming electrodes at a first voltage during each set-up period, the second driving means increases the voltages of the priming electrodes to a second voltage higher than the first voltage and keeps them at the second voltage before the write discharges are generated during each address period, and the third driving means reduces the voltages of the priming electrodes from the second voltage to the first voltage during each sustain period.

6. A plasma display apparatus according to claim 1, wherein the first driving means causes the discharges to be generated between the scan electrodes and the priming electrodes before the discharges between the scan electrodes and the sustain electrodes to adjust the wall charges of the priming electrodes during each set-up period.

7. A plasma display apparatus according to claim 6, wherein:

the first driving means reduces the voltages of the priming electrodes from a first voltage to a second voltage lower than the first voltage and keeps them at the second voltage before the discharges between the scan electrodes and the sustain electrodes during each set-up period, and the second driving means increases the voltages of the priming electrodes from the second voltage to the first voltage and keeps them at the first voltage before the generation of the write discharges during each address period.

8. A plasma display apparatus according to claim 1, wherein the plasma display panel includes light absorbing layers formed at positions opposed to the priming electrodes.

9. A plasma display apparatus according to claim 1, wherein the first driving means sets the set-up period given once during the vertical synchronization period to be longer than the other set-up periods.

10. A plasma display apparatus according to claim 1, wherein the second driving means increases the voltages of the priming electrodes to a predetermined voltage after increasing the voltages of the scan electrodes whose wall charges were adjusted by the first driving means to another predetermined voltage during each address period.

11. A method for driving a plasma display apparatus for displaying images in gradation while dividing one field into a plurality of subfields each including a set-up period, an address period and a sustain period, the apparatus comprising an AC plasma display panel formed with a plurality of scan electrodes and a plurality of sustain electrodes, an electrode array comprised of two scan electrodes and two sustain electrodes arrayed in this order being one unit, and a plurality of priming electrodes each opposed to an adjacent scan electrode, comprising:

an adjusting step of adjusting wall charges of the scan electrodes and the sustain electrodes, between which sustain discharges were generated in the previous subfields, during each set-up period, a writing step of, during each address period, applying write pulses to the scan electrodes having the wall charges thereof adjusted in the adjusting step to generate priming discharges between the scan electrodes and the priming electrodes, and applying write pulses to the data electrodes to generate write discharges utilizing the priming discharges, and a sustaining step of, during each sustain period, causing sustain discharges to be generated between the scan electrodes caused to generate the write discharges in the writing step and the sustain electrodes to accumulate positive charges in the scan electrodes and negative charges in the sustain electrodes after the sustain discharges, wherein the adjusting step includes a step of replacing parts toward the sustain electrodes of the positive charges in the scan electrodes accumulated in the sustaining step by negative charges and replacing parts toward the scan electrodes of the negative charges in the sustain electrodes accumulated in the sustaining step by positive charges.

* * * * *